US010837326B2

(12) United States Patent
Okada et al.

(10) Patent No.: US 10,837,326 B2
(45) Date of Patent: Nov. 17, 2020

(54) VALVE TIMING CONTROL DEVICE FOR INTERNAL COMBUSTION ENGINE

(71) Applicant: HITACHI AUTOMOTIVE SYSTEMS, LTD., Hitachinaka (JP)

(72) Inventors: Shohei Okada, Atsugi (JP); Kotaro Watanabe, Atsugi (JP); Kuninaga Hatsugai, Atsugi (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/622,164

(22) PCT Filed: Apr. 26, 2018

(86) PCT No.: PCT/JP2018/016904
§ 371 (c)(1),
(2) Date: Dec. 12, 2019

(87) PCT Pub. No.: WO2018/230173
PCT Pub. Date: Dec. 20, 2018

(65) Prior Publication Data

US 2020/0123938 A1 Apr. 23, 2020

(30) Foreign Application Priority Data

Jun. 14, 2017 (JP) ..... 2017-116364

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2001/34456* (2013.01);
(Continued)

(58) Field of Classification Search
CPC ..... F01L 1/3442; F01L 2001/3443; F01L 2001/34423; F01L 2001/34469;
(Continued)

(56) References Cited

U.S. PATENT DOCUMENTS 6,374,788 B1 4/2002 Fukuhara et al.
6,460,496 B2 10/2002 Fukuhara et al.
2014/0069361 A1* 3/2014 Watanabe ..... F01L 1/3442 123/90.15

FOREIGN PATENT DOCUMENTS

JP 4017860 B2 12/2007

OTHER PUBLICATIONS

International Search Report dated Jul. 17, 2018 in International Application No. PCT/JP2018/016904.
(Continued)

*Primary Examiner* — Zelalem Eshete
(74) *Attorney, Agent, or Firm* — Foley & Lardner LLP

(57) ABSTRACT

An internal combustion engine valve timing control device includes a communication passage formed in a first rotating member to communicate with a working chamber, and including a first opening. The first opening is opened to a back pressure chamber when a tip portion of a lock member is inserted in a lock hole, and is closed by the lock member when the tip portion of the lock member is out of the lock hole. A first cross-sectional area is smaller than a second cross-sectional area, wherein the first cross-sectional area is a smaller one of a minimum cross-sectional area of the communication passage and an open cross-sectional area of the first opening, and the second cross-sectional area is a smaller one of a minimum cross-sectional area of an exhaust passage and an open cross-sectional area of an opening of the exhaust passage opened to the back pressure chamber.

19 Claims, 19 Drawing Sheets

(52) U.S. Cl.
CPC ..... *F01L 2001/34469* (2013.01); *F01L 2001/34483* (2013.01)

(58) Field of Classification Search
CPC ... F01L 2001/34483; F01L 2001/34456; F01L 2810/04; F01L 2303/00; F01L 2250/04
See application file for complete search history.

(56) References Cited

OTHER PUBLICATIONS

IPRP/Written Opinion of the International Searching Authority (dated Jul. 17, 2018) in International Application No. PCT/JP2018/016904.

* cited by examiner

VALVE TIMING CONTROL DEVICE FOR INTERNAL COMBUSTION ENGINE

BACKGROUND

The present disclosure relates to a valve timing control device for an internal combustion engine.

Japanese Patent No. 4017860 discloses a conventional valve timing control device, which includes: a housing including an inner periphery formed integrally with a plurality of shoes; a vane rotor fixed to one end of an intake or exhaust camshaft of an engine, and mounted rotatably in the housing, and including an outer periphery including a plurality of vanes; advance hydraulic chambers and retard hydraulic chambers, each of which is formed between a corresponding one of the vanes of the vane rotor and a corresponding one of the shoes of the housing; a lock member structured to lock the vane rotor in a predetermined angular position with respect to the housing; an accommodation hole formed in the vane rotor, and structured to accommodate the lock member and a biasing member, wherein the biasing member is structured to bias the lock member; a lock hole formed in the housing, and structured to receive insertion of the lock member; and an unlock passage structured to supply a hydraulic pressure for unlocking the lock member from the lock hole.

For suppression of knocking noise which occurs when a hydraulic pressure of oil containing air is supplied to the unlock passage for unlocking during engine starting, a purge passage and an exhaust hole are provided, wherein the purge passage provides communication between the retard hydraulic chamber, to which the hydraulic pressure is supplied, and a back pressure chamber formed in a rear end portion of the accommodation hole, and wherein the exhaust hole provides communication between the back pressure chamber of the accommodation hole and an atmosphere, and thereby allows a back pressure of the lock member to be exhausted.

SUMMARY

In the conventional valve timing control device described above, the purge passage is set greater in cross-sectional area (opening area) than the exhaust hole. Accordingly, air, which mixes in working oil which has flown from an oil pump into the retard hydraulic chamber during engine starting, flows through the purge passage into the back pressure chamber, wherein the flow of the air into the back pressure chamber is likely to occur because the purge passage is greater in opening area. However, the exhaust of the air from the back pressure chamber to an outside may be insufficient, because the exhaust hole is smaller in opening area. This may cause a rise in internal pressure of the back pressure chamber (pressure of remaining air).

Accordingly, when the lock member is unlocked, it is required to supply a high hydraulic pressure through the unlock passage as required to bring the lock member out of the lock hole. In other words, it becomes difficult to quickly unlock the lock member in accordance with a requested speed.

It is desirable to provide an internal combustion engine valve timing control device capable of quickly unlocking a lock member while suppressing a hydraulic pressure for unlocking from rising excessively.

An embodiment includes a communication passage formed in a first rotating member to communicate with a working chamber, and including a first opening, wherein: the first opening is structured to be opened to a back pressure chamber when in a first state that a tip portion of a lock member is inserted in a lock hole, and be closed by the lock member when in a second state that the tip portion of the lock member is out of the lock hole; a first cross-sectional area is smaller than a second cross-sectional area; the first cross-sectional area is a smaller one of a minimum cross-sectional area of the communication passage and an open cross-sectional area of the first opening; and the second cross-sectional area is a smaller one of a minimum cross-sectional area of an exhaust passage and an open cross-sectional area of an opening of the exhaust passage opened to the back pressure chamber.

According to the preferable embodiment, it is possible to quickly unlock the lock member while suppressing a hydraulic pressure for unlocking from rising excessively.

BRIEF DESCRIPTION OF DRAWINGS

FIG. 16 are views of the lock mechanism according to the third embodiment in a state that a lock pin is engaged in a lock hole, where

FIG. 17 are views of the lock mechanism according to the third embodiment in a state that the lock pin is out of the lock hole, where

FIG. 20 are views of the lock mechanism according to the fourth embodiment in a state that a lock pin is engaged in a lock hole, where

FIG. 21 are views of the lock mechanism according to the fourth embodiment in a state that the lock pin is out of the lock hole, where

FIG. 23 are views of the lock mechanism according to the fifth embodiment in a state that a lock pin is engaged in a lock hole, where

FIG. 24 are views of the lock mechanism according to the fifth embodiment in a state that the lock pin is out of the lock hole, where

FIG. 26 are views of the lock mechanism according to the sixth embodiment in a state that a lock pin is inserted in a lock hole, where

FIG. 27 are views of the lock mechanism according to the sixth embodiment in a state that the lock pin is out of the lock hole, where

DETAILED DESCRIPTION

The following describes internal combustion engine valve timing control devices according to embodiments of the present invention with reference to the drawings. In each embodiment, the valve timing control device is applied to an intake valve side of the engine.

First Embodiment

Figure 1:
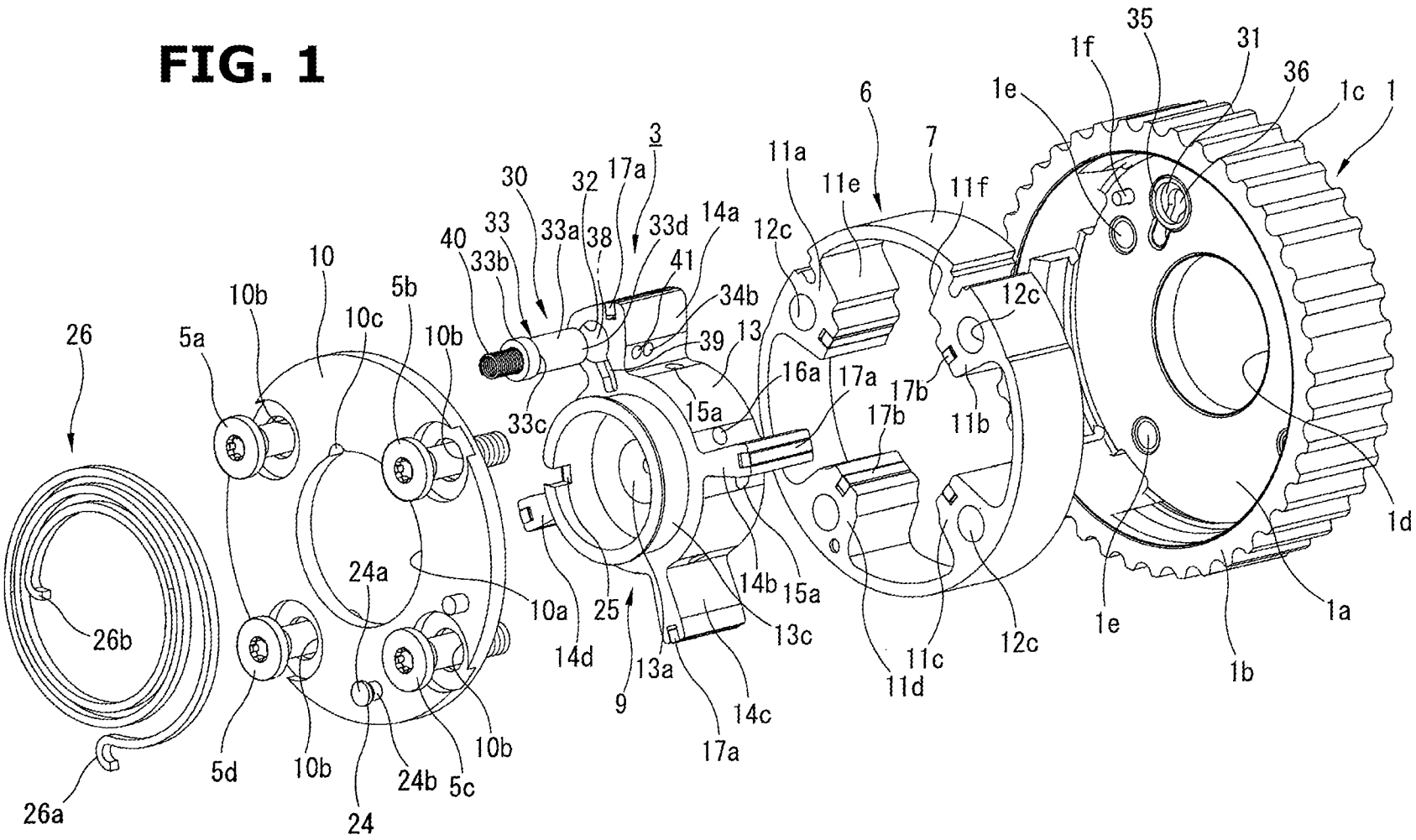
FIG. 1 is an exploded perspective view of an internal combustion engine valve timing control device according to a first embodiment of the present invention.
Figure 2:
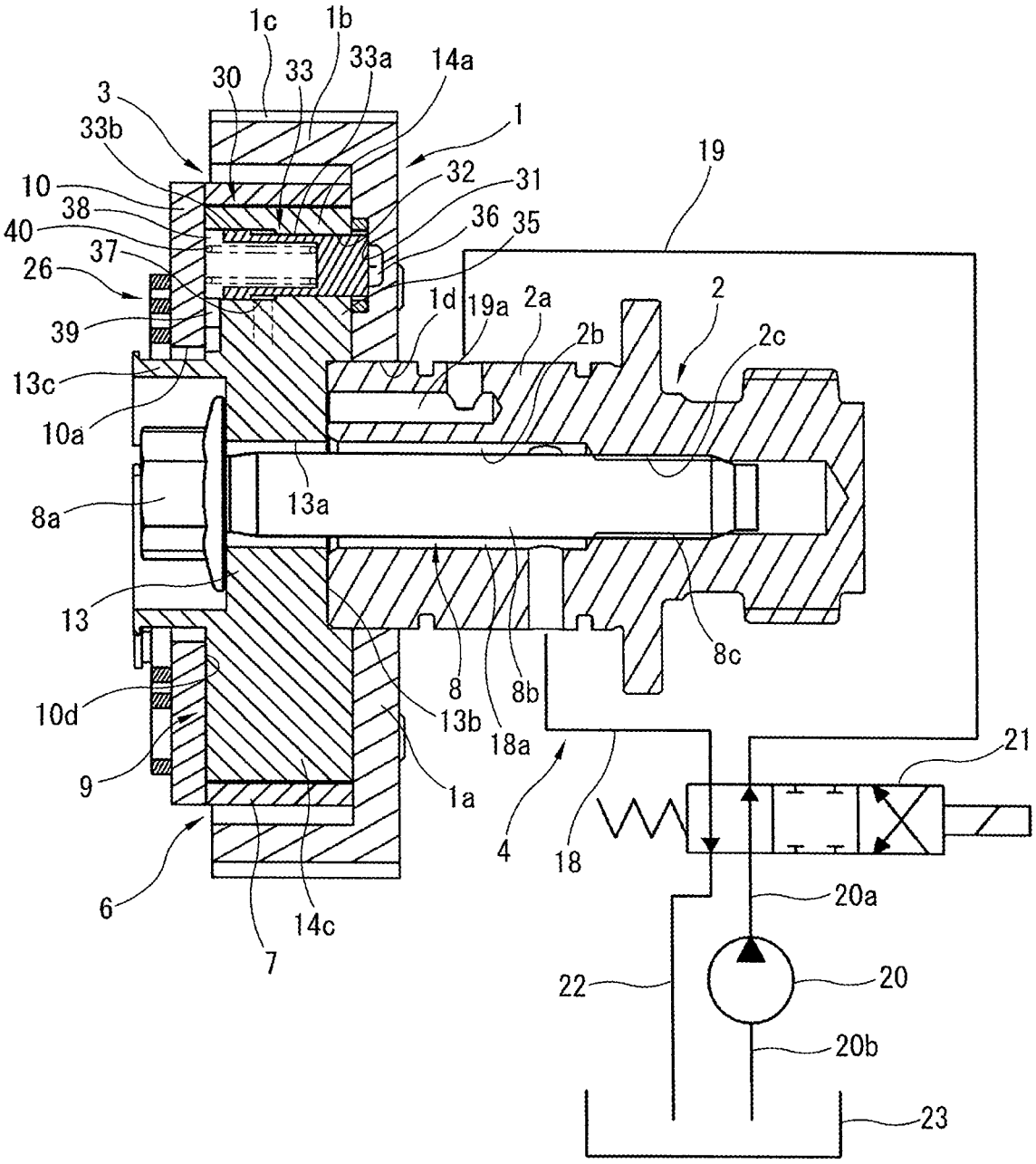
FIG. 2 is a schematic view showing a hydraulic circuit of the internal combustion engine valve timing control device according to the first embodiment.
Figure 3:
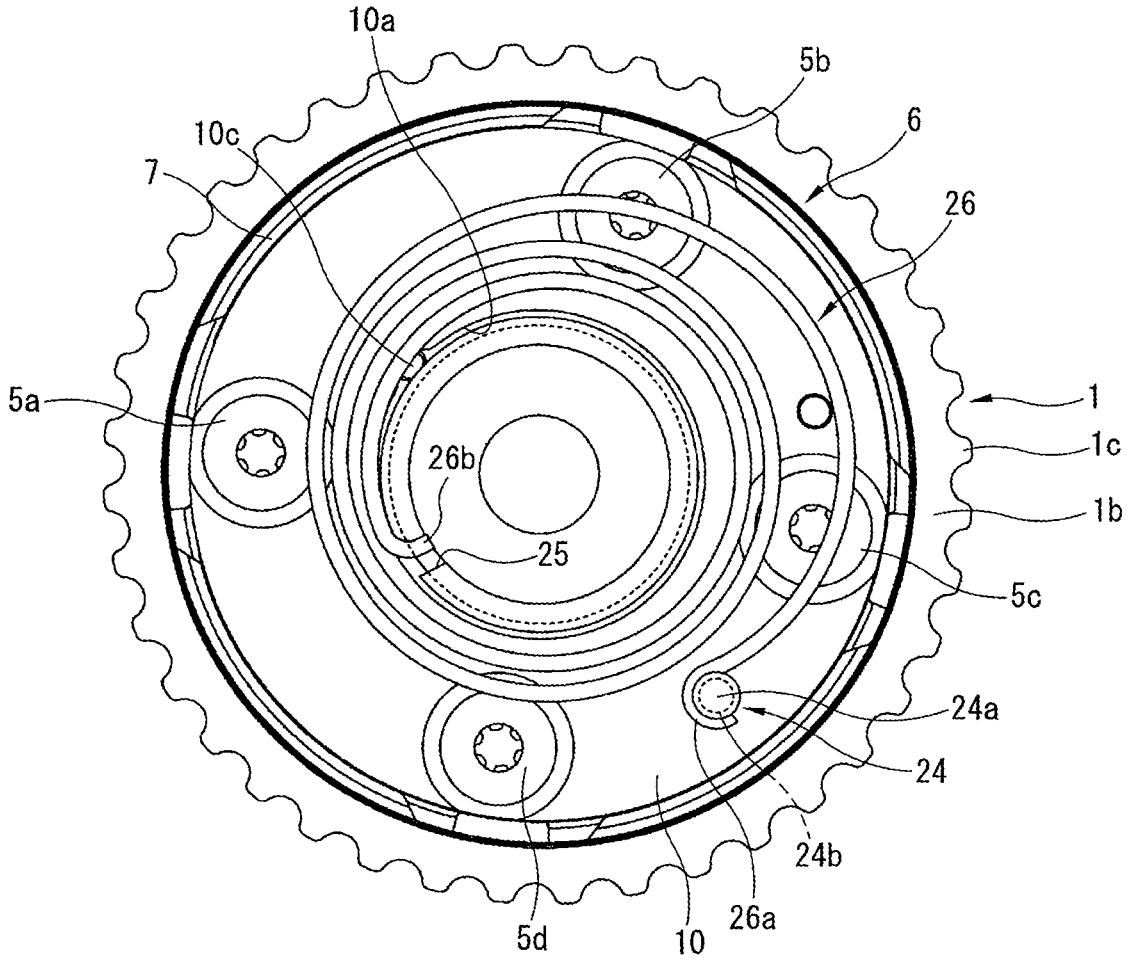
FIG. 3 is a front view of the internal combustion engine valve timing control device according to the first embodiment where a cam bolt is removed.
Figure 4:
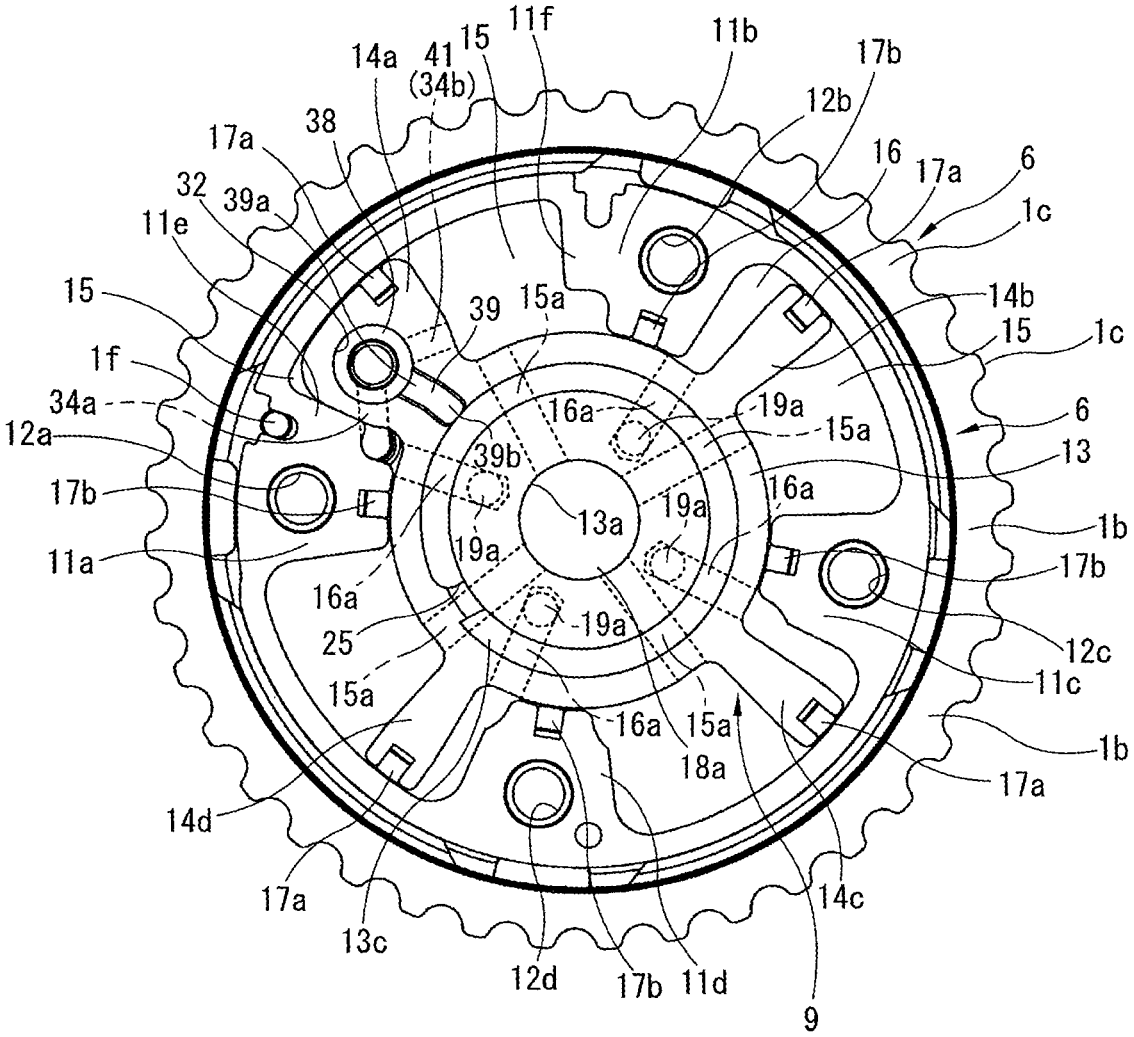
FIG. 4 is a front view of the first embodiment in a state that valve timing is controlled to a retarded point, wherein a front plate is removed from a housing body.
Figure 5:
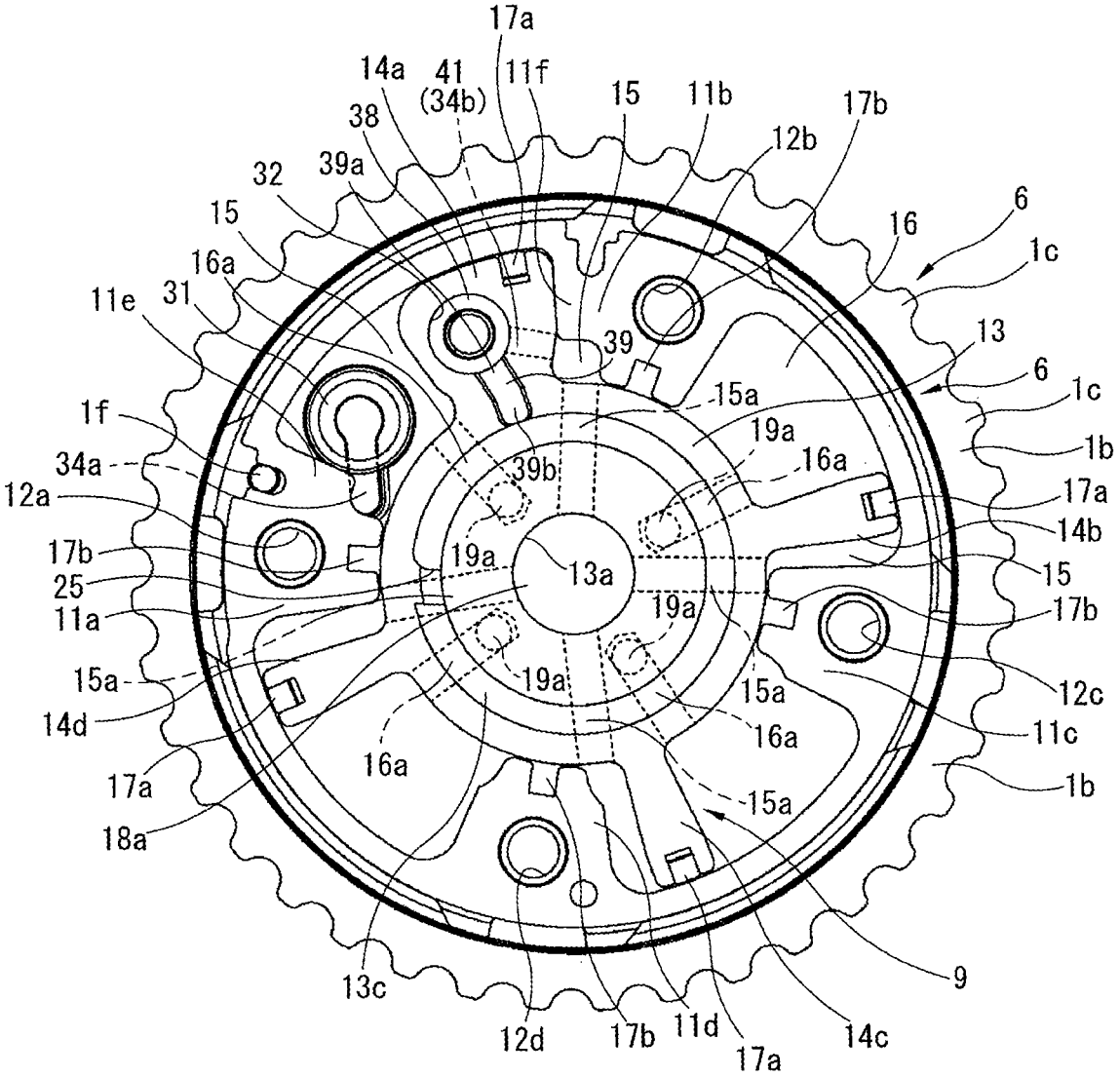
FIG. 5 is a front view of the first embodiment in a state that valve timing is controlled to an advanced point, wherein the front plate is removed from the housing body.

FIG. 1 is an exploded perspective view of the valve timing control device according to a first embodiment of the present invention. FIG. 2 is a schematic view showing a hydraulic circuit of the valve timing control device according to the first embodiment. FIG. 3 is a front view of the valve timing control device according to the first embodiment where a cam bolt is removed. FIG. 4 is a front view of the first embodiment in a state that valve timing is controlled to a retarded point, wherein a front plate is removed from a housing body. FIG. 5 is a front view of the first embodiment in a state that valve timing is controlled to an advanced point, wherein the front plate is removed from the housing body.

As shown in FIGS. 1 and 2, the valve timing control device includes a timing pulley (henceforth referred to as pulley) 1, an intake camshaft 2, a phase-varying mechanism 3, and a hydraulic circuit 4. Pulley 1 is structured to be rotationally driven via a timing belt by a crankshaft not shown of the engine. Camshaft 2 is arranged to extend in a longitudinal direction of the engine, and be rotatable with respect to pulley 1. Phase-varying mechanism 3 is arranged between pulley 1 and camshaft 2, and structured to vary a relative rotational phase between pulley 1 and camshaft 2. Hydraulic circuit 4 is structured to actuate phase-varying mechanism 3.

Pulley 1 is made of sintered metal, and formed by compressing and heating iron-based metal powder, and has a cylindrical tubular shape having a bottom. Pulley 1 includes: a base part 1*a* having a circular plate shape; and a tubular part 1*b* having an axial end formed integrally with an outer periphery of base part 1*a*. Tubular part 1*b* has an outer periphery including a plurality of teeth 1*c* around which the timing belt is wound.

Base part 1*a* includes a support hole 1*d* at its central position, wherein support hole 1*d* extends through. As described below, an outer periphery of a vane rotor, which is fixed to camshaft 2, is inserted and supported in support hole 1*d*. As shown in FIGS. 3 and 4, base part 1*a* has an outer peripheral part including four internal thread holes 1*e* arranged circumferentially, wherein a plurality of bolts described below (four bolts in this example), i.e. first to fourth bolts 5*a*, 5*b*, 5*c*, 5*d* are screwed in corresponding internal thread holes 1*e*. For positioning with a housing body 7 described below, a pin 1*f* is formed in a specific position in an inner face of base part 1*a*.

The base part 1*a* of pulley 1 serves as a rear cover for closing a second end (rear end) opening of housing body 7.

Camshaft 2 is rotatably supported via a cam bearing with respect to a cylinder head not shown, and has an outer periphery to which a plurality of oval cams are fixed in corresponding predetermined positions, wherein each oval cam is structured to open and close an intake valve. As shown in FIG. 2, camshaft 2 includes a first end part 2*a* in its axial direction, wherein first end part 2*a* includes a bolt insertion hole 2*b* that extends in a longitudinal direction of first end part 2*a*, and includes a tip end portion formed with an internal thread hole 2*c*.

As shown in FIGS. 1, 2 and 4, phase-varying mechanism 3 includes: a housing 6 as a second rotating member coupled to pulley 1 in the axial direction, in which a working chamber is formed; a vane rotor 9 as a first rotating member mounted rotatably in housing 6, and fixed to first end part 2*a* of camshaft 2 by a cam bolt 8 in the axial direction; a plurality of retard hydraulic chambers 15 and a plurality of advance hydraulic chambers 16 (four retard hydraulic chambers 15 and four advance hydraulic chambers 16 in this example) which are defined by separation of the working chamber of housing 6 by vane rotor 9.

Housing 6 includes: housing body 7 made of sintered metal similarly as pulley 1, to have a cylindrical tubular shape; a front plate 10 that is a plate member structured to close a front end opening of housing body 7; and pulley 1 that is a plate member structured as a rear cover to close the rear end opening of housing body 7.

Housing body 7 includes an inner periphery formed integrally with a plurality of shoes (four shoes in this example), i.e. first to fourth shoes 11*a*-11*d*, which are substantially evenly spaced in its circumferential direction. Each shoe 11*a*-11*d* includes a bolt insertion hole 12*a*-12*d* that extends through in the axial direction.

Four shoes 11*a*-11*d* have different widths in the circumferential direction. Specifically, of four shoes 11*a*-11*d*, first shoe 11*a* and second shoe lib, which is adjacent to first shoe 11*a* in the circumferential direction, have relatively large widths in the circumferential direction, and are thereby higher in rigidity. On the other hand, third shoe 11*c* and fourth shoe 11*d* adjacent to each other, which are opposite to first shoe 11*a* and second shoe 11*b*, have smaller widths than first shoe 11*a* and second shoe 11*b*.

Each of first shoe 11*a* and second shoe 11*b* includes a side face facing each other in the circumferential direction, wherein the side face includes a raised portion 11*e*, 11*f* structured to be in contact with first vane 14*a* of vane rotor 9 in the circumferential direction.

Cam bolt 8 includes: a head part 8*a* closer to front plate 10; a shaft part 8*b* extending from head part 8*a* into camshaft 2; and an external thread portion 8*c* formed at a tip end portion of shaft part 8*b*, and screwed in internal thread hole 2*c* of camshaft 2.

Front plate 10 is formed by press-forming an iron-based metal plate to have a circular plate shape in this example. Front plate 10 includes a central portion including an insertion hole 10*a* that extends through and has a relatively large diameter, and front plate 10 includes an outer peripheral part formed with four bolt insertion holes 10*b* that are substantially evenly spaced in the circumferential direction, wherein each bolt insertion hole 10*b* is provided with a countersunk hole.

Front plate 10 includes a groove 10*c*, which is formed in a predetermined position in an edge portion of insertion hole 10*a*, and has a circular arc shape, and communicates with an exhaust passage 39 described below.

Front plate 10 is provided with an engagement pin 24 that is formed in a front face of front plate 10, and located in a substantially central position in a radial direction, and structured to engage and retain an outer end portion 26*a* of a torsion spring 26 described below. Engagement pin 24 has a head part 24*a* at its tip end, wherein head part 24*a* has a flange plate shape, and serves to restrict and prevent outer end portion 26*a* of torsion spring 26 from being released out of engagement with a shaft part 24*b* of engagement pin 24.

Housing body 7, front plate 10, and pulley 1 are coupled and fixed together by four bolts 5*a*-5*d*.

Each bolt 5*a*-5*d* includes: a head part at its tip end, which has a groove for engagement with a tool; a shaft part extending from a rear end of the head part; and an external thread portion formed at a tip end portion of the shaft part.

The shaft part of each bolt 5*a*-5*d* has the same diameter, and is inserted in the corresponding bolt insertion hole 10*b* of front plate 10, and the corresponding bolt insertion hole 12*a*-12*d* of shoe 11*a*-11*d*. Furthermore, the external thread portion of the tip end portion is screwed and fixed in internal thread hole 1*e* of pulley 1. Thereby, each bolt 5*a*-5*d* fixes front plate 10, housing body 7, and pulley 1 together in the axial direction.

Vane rotor 9 is formed integrally by compressing and sintering metal powder in this example. Vane rotor 9 includes: a rotor 13 fixed directly to first end part 2*a* of camshaft 2 by cam bolt 8; and a plurality of vanes (four vanes in this example), i.e. first to fourth vanes 14*a*-14*d* arranged in the outer periphery of rotor 13, and evenly spaced at intervals of about 90° in the circumferential direction, and extending radially.

Rotor 13 has a cylindrical tubular shape extending in the axial direction, and has a central portion including an insertion hole 13*a* extending through in the axial direction, wherein shaft part 8*b* of cam bolt 8 is inserted in insertion hole 13*a*. Rotor 13 has a rear end closer to camshaft 2 where a fitting recess 13*b* is formed and has a cylindrical shape, wherein first end part 2*a* of camshaft 2 is fitted in fitting recess 13*b*.

Rotor 13 is formed integrally with a tubular part 13*c* at its front end edge in the axial direction, wherein tubular part 13*c* has a thin thickness, and is inserted in insertion hole 10*a* of front plate 10. Tubular part 13*c* includes an engagement slot 25 in a predetermined position in the circumferential direction of the front end edge, wherein engagement slot 25 has a rectangular shape, and engages and retains an inner end portion 26*b* of torsion spring 26 described below.

As shown in FIGS. 1, 4, and 5, each of first to fourth vanes 14*a*-14*d* is formed integrally with the outer periphery of rotor 13, and arranged between corresponding shoes 11*a*-11*d*. Vanes 14*a*-14*d* and shoes 11*a*-11*d* define retard hydraulic chambers 15 and advance hydraulic chambers 16.

The tip end portion of each vane 14*a*-14*d* includes an outer periphery including a seal groove that extends in the axial direction, wherein a seal member 17*a* is fitted and fixed to the seal groove, and structured to slide on and seal the inner periphery of housing body 7. On the other hand, the inner periphery of the tip end portion of each shoe 11*a*-11*d* includes a seal groove, wherein a seal member 17*b* is fitted and fixed to the seal groove and structured to slide on and seal the outer periphery of rotor 13.

As shown in FIG. 4, when vane rotor 9 relatively rotates to a most retarded position, one side face of first vane 14*a* is brought into contact with an outer face of raised portion lie of first shoe 11*a* facing the first vane 14*a*, thereby restricting the rotational position of vane rotor 9 in the most retarded position. On the other hand, as shown in FIG. 5, when vane rotor 9 relatively rotates to a most advanced position, the other side face of first vane 14*a* is brought into contact with an outer surface of raised portion 11*f* of second shoe 11*b* facing the first vane 14*a*, thereby restricting the rotational position of vane rotor 9 in the most advanced position. First vane 14*a*, first shoe 11*a*, and second shoe 11*b* serve as a mechanical stopper to restrict vane rotor 9 between the most retarded relative rotational position and the most advanced relative rotational position.

On the other hand, each of the other three vanes, i.e. each of second to fourth vanes 14*b*-14*d* is maintained out of contact with a side face of shoe 11*a*-11*d* facing the each vane in the circumferential direction. This serves to enhance accuracy of contact between first vane 14*a* and each of first shoe 11*a* and second shoe 11*b*, and also enhance the speed of supply of hydraulic pressure to retard hydraulic chambers 15 and advance hydraulic chambers 16, and thereby enhance the responsiveness of normal rotation and reverse rotation of vane rotor 9.

As shown in FIGS. 2, 4, and 5, each of retard hydraulic chambers 15 and advance hydraulic chambers 16 is structured to communicate with hydraulic circuit 4 via a corresponding communication hole 15*a*, 16*a* that is formed in rotor 13 to extend radially.

As shown in FIG. 3, torsion spring 26 has a spiral shape, and has a rectangular cross-section. Outer end portion 26*a* of torsion spring 26 is formed by folding to have an U-shape, and engaged with shaft part 24*b* of engagement pin 24 of front plate 10. On the other hand, inner end portion 26*b* of torsion spring 26 is formed by folding to have an L-shape, and engaged with an edge of engagement slot 25 of rotor 13.

With engagement of outer end portion 26*a* and inner end portion 26*b*, torsion spring 26 causes a spring force to bias vane rotor 9 in an advance direction with respect to housing 6. This serves to suppress an alternating torque (cam torque), which occurs in camshaft 2 when the engine is started or operated, especially, a negative torque, from naturally causing a torque to rotate vane rotor 9 relatively in a retard direction. This serves to enhance the accuracy of the relative rotation angle of vane rotor 9 set by phase-varying mechanism 3. The spring force of torsion spring 26 is set relatively small and at least capable to slightly suppress the negative torque.

As shown in FIGS. 2, 4, and 5, hydraulic circuit 4 is structured to selectively supply hydraulic pressures of working oil to and drain the hydraulic pressures from retard hydraulic chambers 15 and advance hydraulic chambers 16. Hydraulic circuit 4 includes a retard oil passage 18, an advance oil passage 19, an oil pump 20, and an electromagnetic switching valve 21. Retard oil passage 18 is structured to supply hydraulic pressures to and drain the hydraulic pressures from retard hydraulic chambers 15. Advance oil passage 19 is structured to supply hydraulic pressures to and drain the hydraulic pressures from advance hydraulic chambers 16. Oil pump 20 is a fluid pressure supply source structured to supply a hydraulic pressure selectively to retard oil passage 18 and advance oil passage 19. Electromagnetic switching valve 21 is structured to switch flow paths of retard oil passage 18 and advance oil passage 19, in accordance with an operating state of the engine.

Each of retard oil passage 18 and advance oil passage 19 has a first end connected to a corresponding supply/drain port formed in a valve body of electromagnetic switching valve 21. On the other hand, each of retard oil passage 18 and advance oil passage 19 has a second end connected to a corresponding one of a retard oil passage section 18*a* and an advance oil passage section 19*a*, wherein retard oil passage section 18*a* has a cylindrical tubular shape, and is formed between bolt insertion hole 2*b* of first end part 2*a* of the camshaft and shaft part 8*b* of cam bolt 8, and wherein advance oil passage section 19*a* is formed in first end part 2*a* of the camshaft to extend in the axial direction. Retard oil passage section 18*a* communicates with retard hydraulic chambers 15 via corresponding first communication holes 15*a* formed in rotor 13. On the other hand, advance oil passage section 19*a* communicates with advance hydraulic chambers 16 via corresponding second communication holes 16*a* formed in rotor 13.

Oil pump 20 is a common type pump such as a trochoid pump, which is rotationally driven by the crankshaft of the engine. Oil pump 20 includes a suction passage 20*b* and a drain passage 22 which communicate with oil pan 23.

Oil pump 20 includes a discharge passage 20*a*, wherein a filter not shown is provided in a downstream section of discharge passage 20*a*, and wherein the downstream section communicates with a main oil gallery M/G for supplying lubricating oil to sliding parts of the engine. Oil pump 20 is further provided with a relief valve not shown which is structured to drain an excessive amount of working oil, which is discharged via discharge passage 20*a*, to oil pan 23, and thereby control a flow rate of discharge suitably.

Electromagnetic switching valve 21 is a proportional valve having four ports and three positions, and is structured to move a spool valve element not shown forward and rearward, by a pulse electric current outputted by a control unit not shown, wherein the spool valve element is mounted in a valve body for sliding in its longitudinal direction. This provides communication between discharge passage 20*a* of oil pump 20 and one of oil passages 18, 19, and simultaneously provides communication between drain passage 22 and the other of oil passages 18, 19.

The control unit includes an internal computer that is configured to receive input of informational signals from various sensors, and determine the current operating state of the engine, wherein the sensors include a crank angle sensor not shown (for engine speed sensing), an air flow meter, an engine water temperature sensor, an engine temperature sensor, a throttle valve opening sensor, and a cam angle sensor for sensing the current rational phase of camshaft 2. The control unit is configured to output a control pulse electric current to each coil of electromagnetic switching valve 21, and control the travel position of the spool valve element for passage switching control.

Between housing 6 and vane rotor 9, a lock mechanism 30 is provided to lock vane rotor 9 in the most retarded rotational position with respect to housing 6 (shown in FIG. 4).

Figure 6:
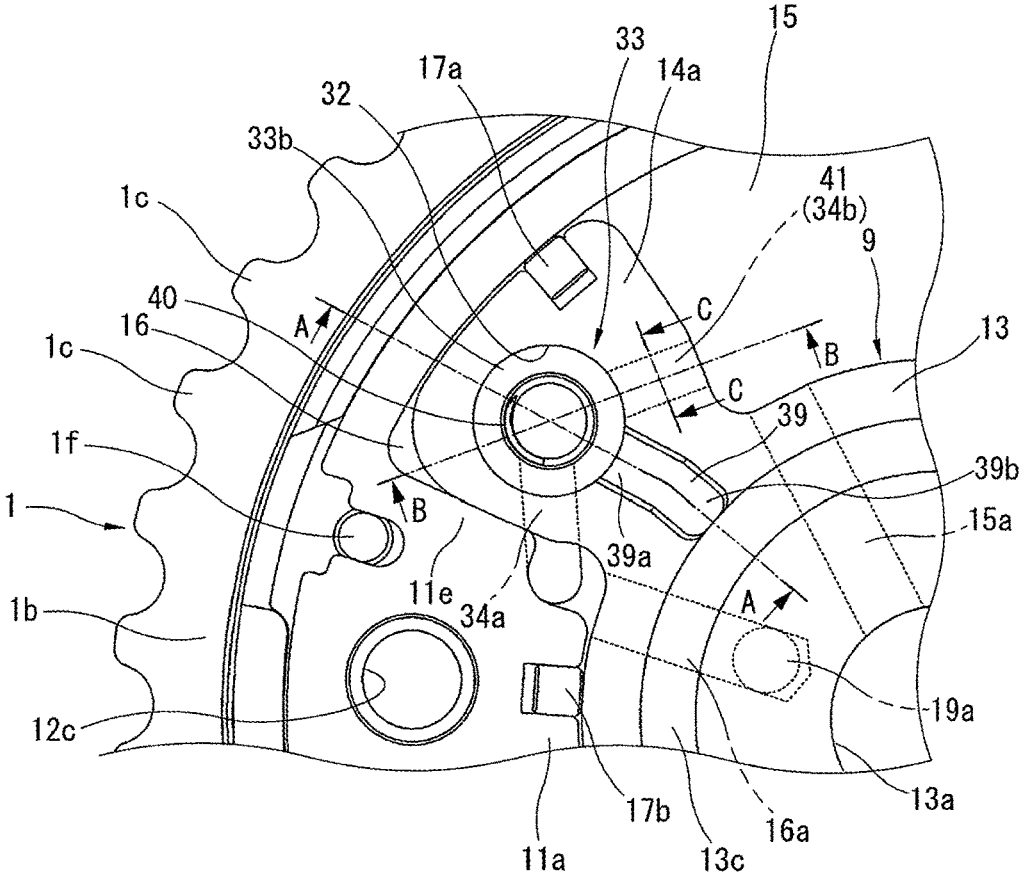
FIG. 6 is an enlarged view of a related part of FIG. 4.
Figure 7A:
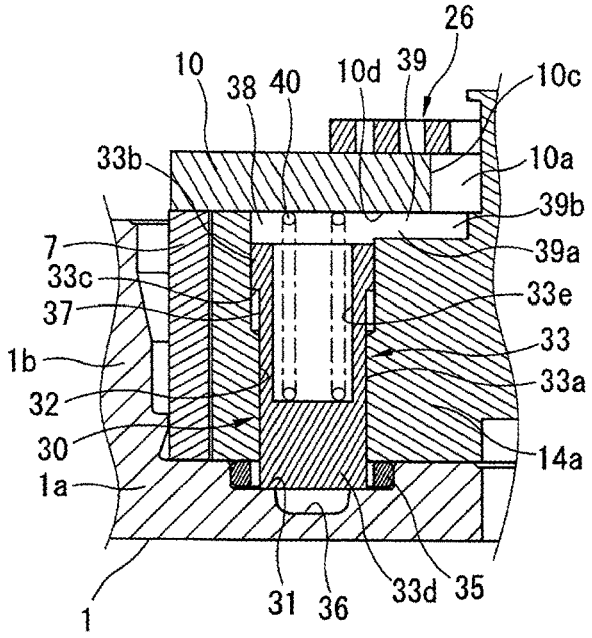
FIG. 7A is a sectional view taken along a line A-A in FIG. 6.
Figure 7B:
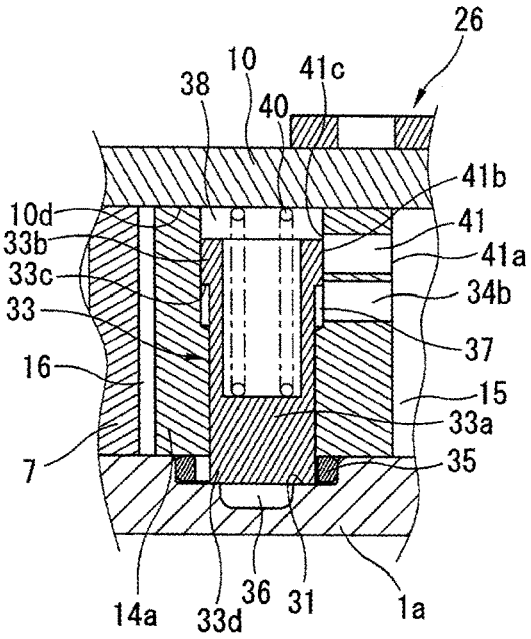
FIG. 7B is a sectional view taken along a line B-B in FIG. 6.
Figure 8A:
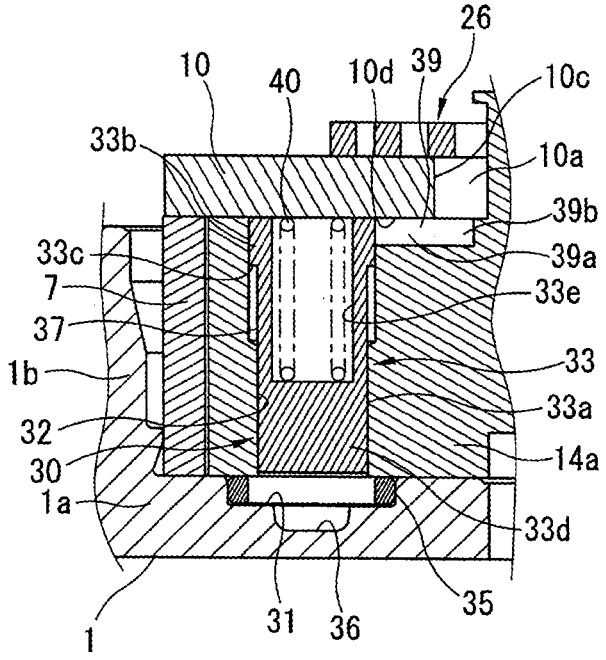
FIG. 8A is a sectional view taken along a line A-A in FIG. 6.
Figure 8B:
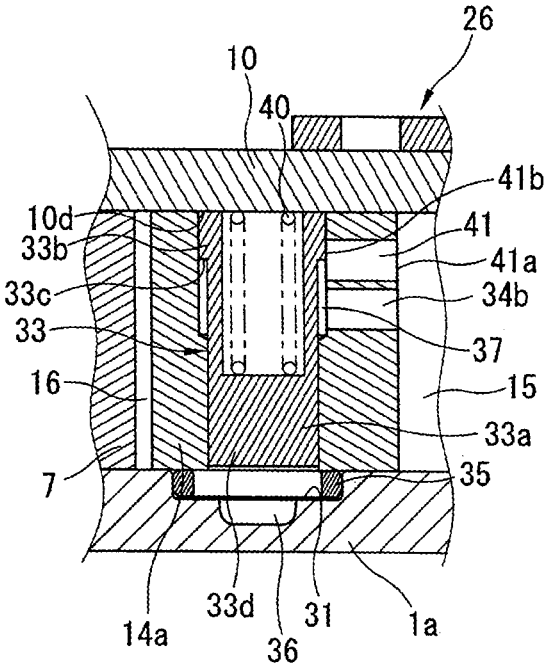
FIG. 8B is a sectional view taken along a line B-B in FIG. 6.
Figure 9:
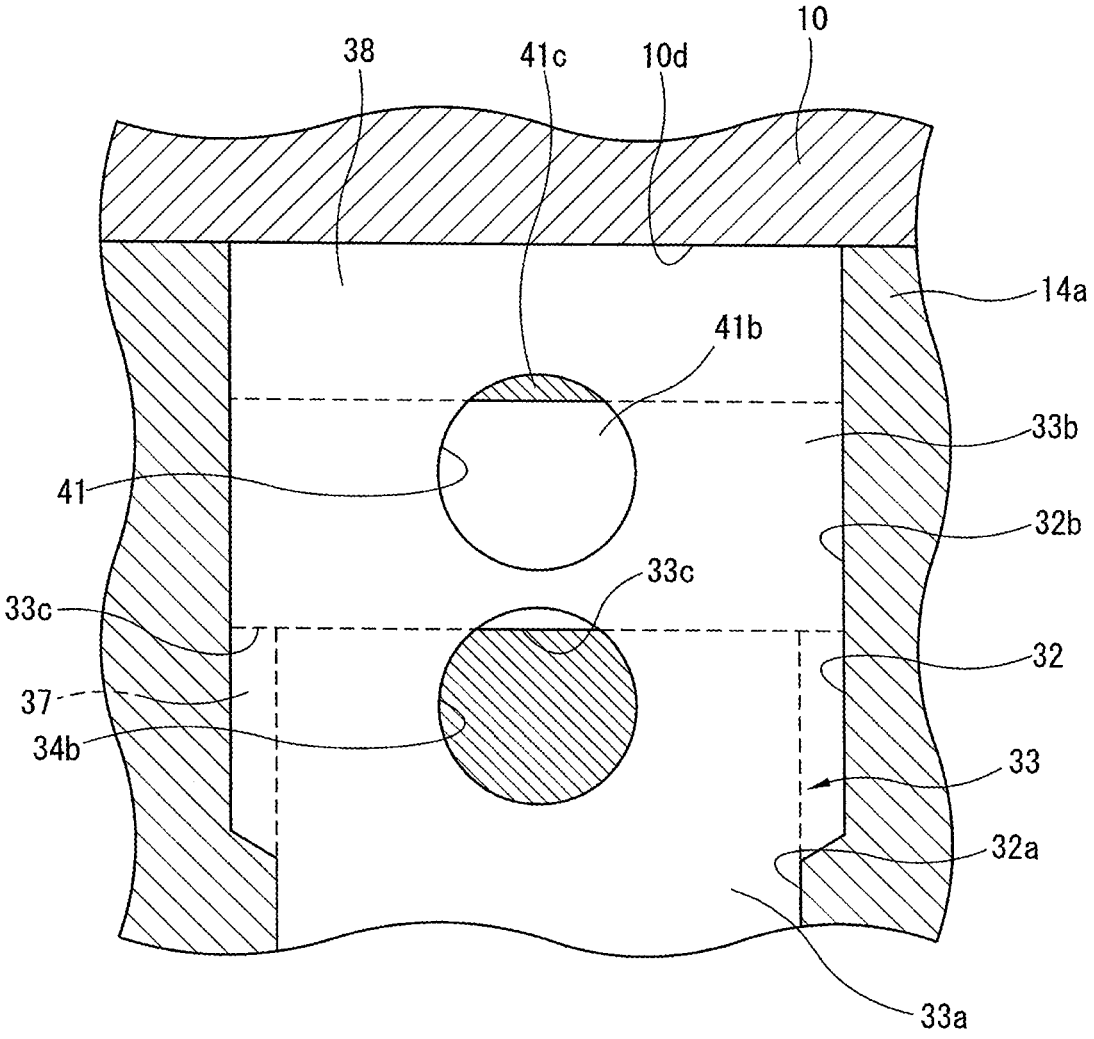
FIG. 9 is a sectional view taken along a line C-C in FIG. 6.
Figure 10:
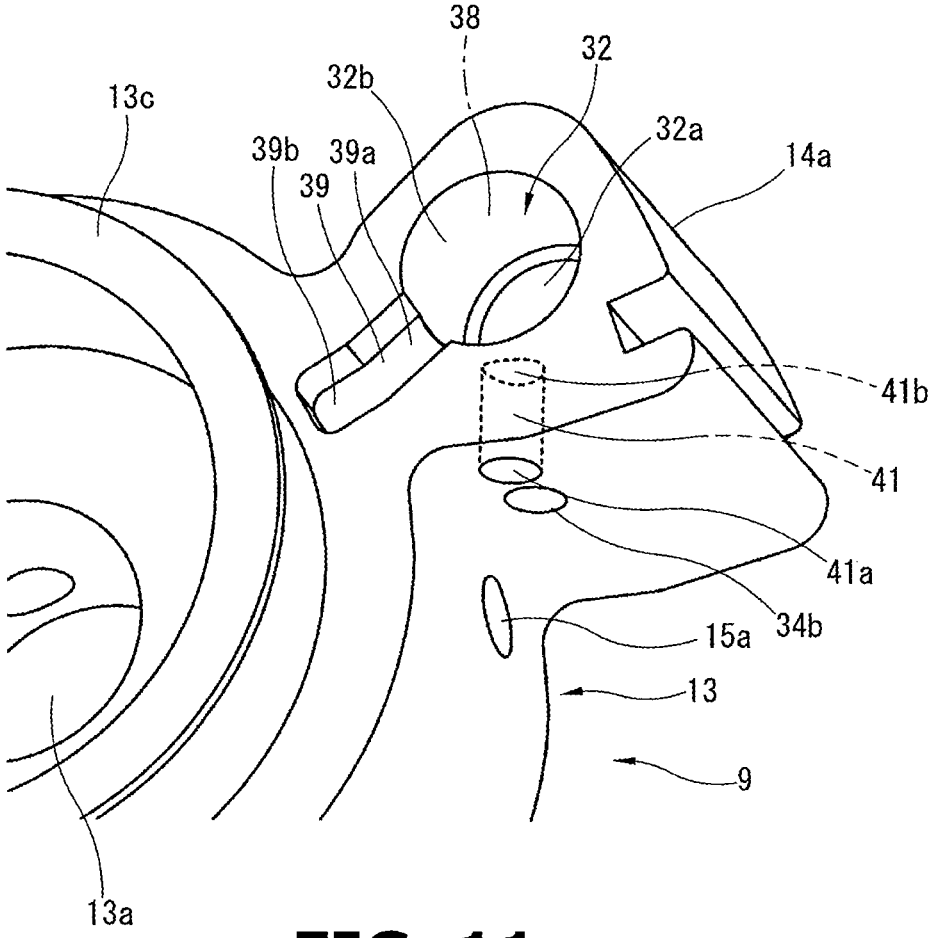
FIG. 10 is an enlarged perspective view of a part including a first vane.

FIGS. 6-10 are enlarged and detailed views of lock mechanism 30 from some viewpoints. FIG. 6 is an enlarged view of a related part of FIG. 4. FIG. 7A is a sectional view taken along a line A-A in FIG. 6. FIG. 7B is a sectional view taken along a line B-B in FIG. 6. FIG. 8A is a sectional view taken along a line A-A in FIG. 6. FIG. 8B is a sectional view taken along a line B-B in FIG. 6. FIG. 9 is a sectional view taken along a line C-C in FIG. 6. FIG. 10 is an enlarged perspective view of a part including the first vane.

Specifically, as shown in FIGS. 1, 2, and 4, lock mechanism 30 generally includes a lock hole 31, a pin accommodation hole 32, a lock pin 33, and first and second unlock passages 34*a*, 34*b* in pairs. Lock hole 31 is a lock recess formed in the inner face of base part 1*a* of pulley 1. Pin accommodation hole 32 is formed in first vane 14*a* to extend in the axial direction. Lock pin 33 is a lock member structured to be slidably mounted in pin accommodation hole 32, and has a tip portion 33*d* structured to be inserted in lock hole 31, and be drawn out of lock hole 31. Each unlock passage 34*a*, 34*b* is formed in first vane 14*a*, and structured to cause lock pin 33 to get out of lock hole 31, and thereby unlock the lock pin 33.

Lock hole 31 has a circular shape having a bottom, and includes an inner periphery where a hole-forming part 35 is press-fitted and fixed. Hole-forming part 35 is made of sintered metal similarly as pulley 1, to have an annular shape, and have a greater hardness than pulley 1. For example, the hardness of lock hole-forming part 35 after sintering is set higher than that of pulley 1, by enhancing the density of metal powder during sintering formation.

Hole-forming part 35 is formed to have an inside diameter greater slightly than the outside diameter of tip portion 33*d* of lock pin 33, for allowing the tip portion 33*d* of lock pin 33 to be accurately inserted and engaged in hole-forming part 35, and drawn and disengaged from hole-forming part 35.

Lock hole 31 includes a central portion in its bottom, which is formed with a first pressure-receiving chamber 36 to which one end of first unlock passage 34*a* is opened. First pressure-receiving chamber 36 has a thin cylindrical shape having a small diameter, and faces a tip end face of tip portion 33*d* of lock pin 33, and communicates with first unlock passage 34*a*.

Pin accommodation hole 32 is formed in first vane 14*a* to extend through in the axial direction of rotor 13. Pin accommodation hole 32 includes: a smaller-diameter hole section 32*a* extending from a central position in the axial direction toward base part 1*a* (front side); a larger-diameter hole section 32*b* closer to front plate 10 (rear side); and a step hole section formed between smaller-diameter hole section 32*a* and larger-diameter hole section 32*b*.

Lock pin 33 includes: a pin body 33*a* mounted to slide on an inner peripheral surface of smaller-diameter hole section 32*a* of pin accommodation hole 32; a flange 33*b* formed integrally with a rear end of pin body 33*a* closer to front plate 10, and is mounted to slide on larger-diameter hole section 32*b*; and a step face 33*c* formed between flange 33*b* and pin body 33*a*.

Pin body 33*a* has a cylindrical outer peripheral surface having a simply straight shape, and is mounted to slide on smaller-diameter hole section 32*a* liquid-tightly. The tip portion 33*d* of pin body 33*a* is set to have an outside diameter that is slightly less than the inside diameter of hole-forming part 35, for allowing engagement and disengagement with lock hole 31 (hole-forming part 35) in lock hole 31 (hole-forming part 35).

Flange 33*b* has a predetermined width in the longitudinal direction of lock pin 33, and has an outer peripheral surface structured to slide on larger-diameter hole section 32*b* liquid-tightly. Flange 33*b* includes a rear end surface that is structured to be in contact with inner end face 10*d* of front plate 10, and thereby restrict further rearward movement of lock pin 33.

Lock pin 33 is formed with a spring accommodation chamber 33*e* that extends in the longitudinal direction from the rear end face of flange 33*b*. Between the rear end face of flange 33*b* and the inner end face 10*d* of front plate 10, a back pressure chamber 38 is formed to communicate with spring accommodation chamber 33*e*.

As shown in FIGS. 1, 2, and 4 to 8, back pressure chamber 38 is located in a second slide direction of lock pin 33, namely, between the rear end of larger-diameter hole section 32*b* of pin accommodation hole 32 and the inner end face 10*d* of front plate 10. Back pressure chamber 38 communicates with exhaust passage 39 that is formed in a first side face of first vane 14*a* closer to front plate 10 in the axial direction.

Back pressure chamber 38 has a volume that varies depending on the slide position of lock pin 33, and is minimized when flange 33*b* of lock pin 33 is in contact with inner end face 10*d* of front plate 10.

Exhaust passage 39 is formed between a groove in the first side face of first vane 14*a* and the inner end face 10*d* of front plate 10 covering the groove, wherein the groove has a predetermined width and extends from an edge of back pressure chamber 38 inward in a radial direction of vane rotor 9. Exhaust passage 39 includes: an upstream opening 39*a* opened to back pressure chamber 38; and a downstream opening 39*b* close to the outer periphery of tubular part 13*c*. The downstream opening 39*b* of exhaust passage 39 is opened to insertion hole 10*a* and groove 10*c* of front plate 10. Accordingly, back pressure chamber 38 communicates with the atmosphere. Exhaust passage 39 serves to ensure smooth slide of lock pin 33 in pin accommodation hole 32 by exhaust of air from back pressure chamber 38.

Exhaust passage 39 has a cross-sectional area that is substantially constant from upstream opening 39*a* to downstream opening 39*b*. In the following, the cross-sectional area of upstream opening 39*a* is compared with that of a small opening part 41*c* of a communication passage 41 described below.

The step face 33*c* of lock pin 33 defines a second pressure-receiving chamber 37 between step face 33*c* and a step section of pin accommodation hole 32. Second pressure-receiving chamber 37 has an annular shape around pin body 33*a*, and communicates with second unlock passage 34*b*.

Lock pin 33 is biased by a spring force of a coil spring 40 in a direction of insertion of tip portion 33*d* into lock hole 31, wherein coil spring 40 is a biasing member accommodated in spring accommodation chamber 33*e*. Coil spring 40 has a first end in elastic contact with the bottom face of spring accommodation chamber 33*e*, and a second end in elastic contact with inner end face 10*d* of front plate 10, biasing the lock pin 33.

First unlock passage 34*a* is formed in a first side part of first vane 14*a*, for supply of hydraulic pressure from advance hydraulic chamber 16 to first pressure-receiving chamber 36. On the other hand, second unlock passage 34*b* is formed in a second side part of first vane 14*a*, for supply of hydraulic pressure from retard hydraulic chamber 15 to second pressure-receiving chamber 37. Accordingly, lock pin 33 receives the hydraulic pressure, which is supplied to retard hydraulic chamber 15 or advance hydraulic chamber 16, at first pressure-receiving chamber 36 or second pressure-receiving chamber 37 via first unlock passage 34*a* or second unlock passage 34*b*. By the hydraulic pressure supplied to first pressure-receiving chamber 36 or second pressure-receiving chamber 37, lock pin 33 gets out of lock hole 31 against the spring force of coil spring 40, and thereby releases the locking with respect to housing 6.

First vane 14*a* includes a communication passage 41 in the second side part where second unlock passage 34*b* is formed, wherein communication passage 41 exhausts air to back pressure chamber 38, wherein the air has mixed in working oil supplied into retard hydraulic chamber 15.

As shown in FIGS. 8 to 10, communication passage 41 is formed in the second side part of first vane 14*a*, and is substantially parallel to second unlock passage 34*b*, and is closer to front plate 10 in the thickness direction of first vane 14*a*. Accordingly, communication passage 41 is parallel to second unlock passage 34*b* with a predetermined short span P.

Communication passage 41 has a cylindrical shape having a constant inside diameter that is substantially equal to that of second unlock passage 34*b*, and includes a first end opening 41*a* (second opening) facing the retard hydraulic chamber 15, and a second end opening 41*b* facing the back pressure chamber 38 of pin accommodation hole 32.

When tip portion 33*d* of lock pin 33 is inserted and maintained in lock hole 31 by the spring force of coil spring 40 as shown in FIGS. 7A and 7B, a major part of second end opening 41*b* of communication passage 41 is closed by the outer peripheral face of flange 33*b* as shown in FIG. 9. Specifically, under this condition, the closure of the major part of second end opening 41*b* forms a small passage part 41*c* (first opening) having a crescentic shape as indicated by hatched pattern in the upper half of FIG. 9, wherein only small opening part 41*c* communicates with back pressure chamber 38.

When tip portion 33*d* of lock pin 33 is out of lock hole 31 as shown in FIGS. 8A and 8B, the entire part of second end opening 41*b* of communication passage 41, which includes small passage part 41*c*, is closed by the outer peripheral face of flange 33*b*. Specifically, under this condition, small opening part 41*c* of second end opening 41*b* is closed, but the other part of second end opening 41*b* communicates with second pressure-receiving chamber 37, as well as second unlock passage 34*b*.

The open cross-sectional area of small passage part 41*c* of communication passage 41 (first cross-sectional area) is set smaller than the open cross-sectional area of upstream opening 39*a* of exhaust passage 39 facing the back pressure chamber 38 (second cross-sectional area). Specifically, the ratio of first cross-sectional area Se to second cross-sectional area Sv is set smaller than or equal to 0.18.

The first cross-sectional area of small opening part 41*c* is set greater than or equal to 1 $mm^2$.

Figure 11:
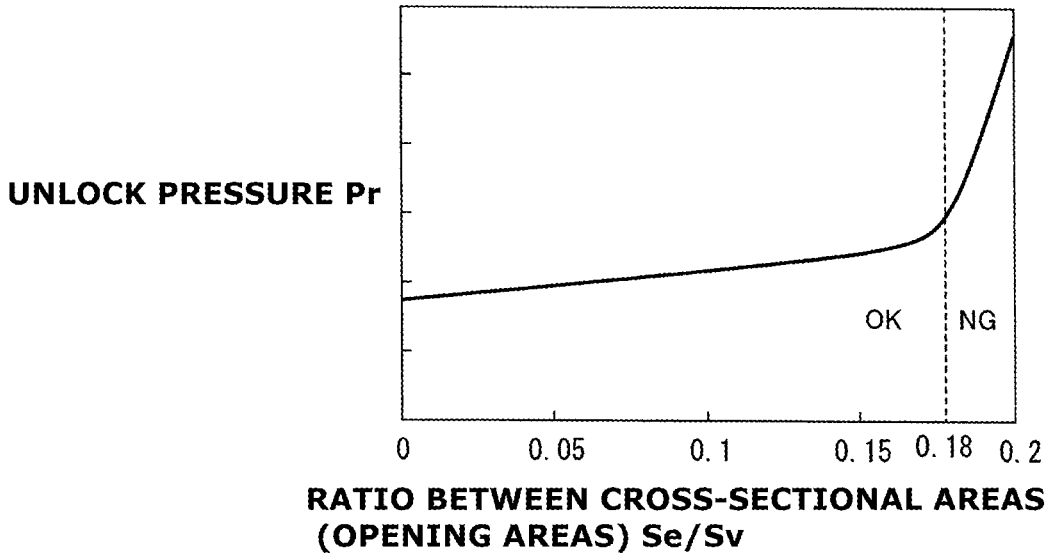
FIG. 11 is a graph showing a relationship between an unlock pressure of a lock pin and a ratio of a first cross-sectional area (opening area) of a small opening part of a communication passage to a second cross-sectional area (opening area) of an opening part of an exhaust groove according to the first embodiment.
Figure 12:
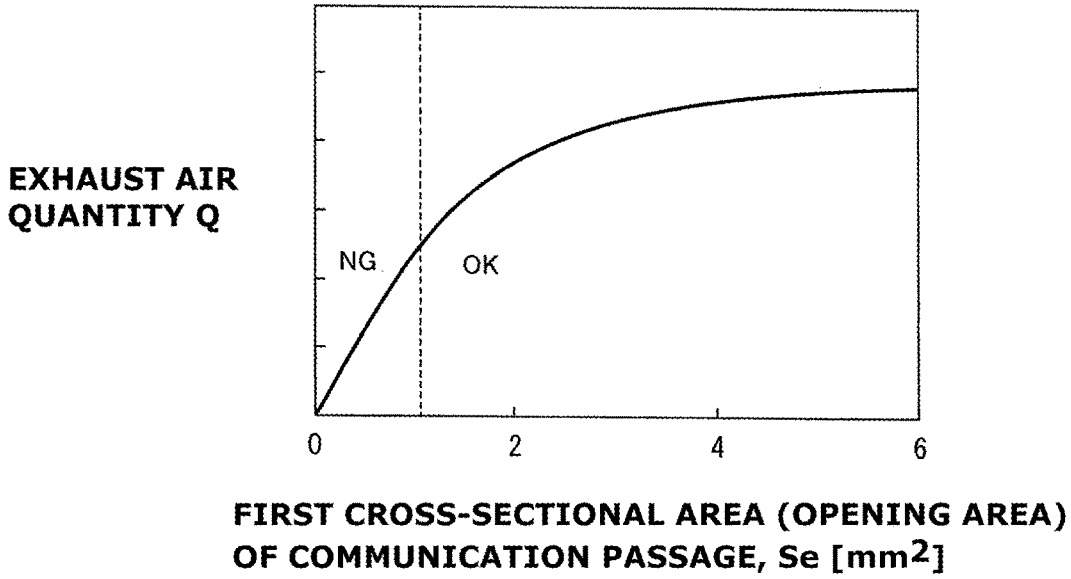
FIG. 12 is a graph showing a relationship between the opening area of the small opening part of the communication passage and a quantity of exhaust air through the communication passage according to the first embodiment.

FIGS. 11 and 12 show results of many experiments made by the present inventor(s) about unlock pressure of lock pin 33 and aft exhaust quantity under a condition that the first cross-sectional area (open cross-sectional area) of second end opening 41*b* (small passage part 41*c*) of communication passage 41 is made to vary.

FIG. 11 is a graph showing a relationship of unlock pressure Pr of lock pin 33 with respect to the ratio of first cross-sectional area (open cross-sectional area) Se of small opening part 41*c* of communication passage 41 to the second cross-sectional area (open cross-sectional area) Sv of upstream opening 39*a* of exhaust passage 39. FIG. 12 is a graph showing a relationship between the first cross-sectional area (open cross-sectional area) Se of small passage part 41*c* of communication passage 41 and the exhaust air quantity Q of communication passage 41.

Specifically, first, based on the relationship of FIG. 11 between unlock pressure Pr and the ratio (in open cross-sectional area) Se/Sv between first cross-sectional area Se and second cross-sectional area Sv, setting the ratio (in open cross-sectional area) Se/Sv between first cross-sectional area Se and second cross-sectional area Sv to be greater than or equal to about 0.18, causes a significant increase in the internal pressure of back pressure chamber 38. This is combined with the spring force of coil spring 40, to cause a resultant force to suppress the lock pin 33 from being out of lock hole 31.

Namely, it has been found that unless unlock pressure Pr, which is supplied from unlock passage 34*a*, 34*b* to first pressure-receiving chamber 36 or second pressure-receiving chamber 37, is set high against the internal pressure of back pressure chamber 38, lock pin 33 cannot exit form lock hole 31 at a speed suitable for a requested speed.

However, if the ratio between the first and second cross-sectional areas (open cross-sectional areas) Se/Sv is set between 0 and about 0.18, the rise of the internal pressure of back pressure chamber 38 (back pressure) is slow, so that unlock pressure Pr is sufficiently low. Namely, the air which has flown from communication passage 41 into back pressure chamber 38 is quickly exhausted to the outside (atmosphere) via exhaust passage 39. It has been found that the hydraulic pressure supplied to second pressure-receiving chamber 37 allows lock pin 33 to easily exit from lock hole 31 against the resultant force of the internal pressure of back pressure chamber 38 and the spring force of coil spring 40.

Namely, it has been found that lock pin 33 can easily exit from lock hole 31 at a speed suitable for the requested speed, even if unlock pressure Pr supplied from second unlock passage 34*b* to second pressure-receiving chamber 37 is low.

The requested speed is a speed of response of start of rotation control of vane rotor 9 with respect to housing 6. For example, as described below, it is a speed of response of satisfaction of a condition where free rotation of vane rotor 9 in the advance direction with respect to housing 6 is possible when the engine shifts from idling operation to operation in a middle load region.

In view of the foregoing, in the first embodiment, the ratio between first cross-sectional area Se and second cross-sectional area Sv is set less than or equal to 0.18.

Next, with reference to FIG. 12, based on the relationship between the first cross-sectional area (open cross-sectional area) Se of small opening part 41*c* of communication passage 41 and the exhaust air quantity Q, which is a quantity per unit time of air mixed in working oil and exhausted from small passage part 41*c* to back pressure chamber 38, it has been found that if the first cross-sectional area Se is set less than or equal to about 1 $mm^2$, the exhaust air quantity Q is small.

However, if the first cross-sectional area Se is set greater than or equal to about 1 $mm^2$, the exhaust air quantity per unit time Q is large.

The exhaust air quantity per unit time Q from retard hydraulic chamber 15 into back pressure chamber 38 is an exhaust quantity of air allowing to prevent action of air on second pressure-receiving chamber 37, and prevent lock pin 33 from being released in unintentional timing.

For example, if air in retard hydraulic chamber 15 is not quickly exhausted to back pressure chamber 38 by working oil supplied from retard oil passage 18 to retard hydraulic chamber 15 by operation of oil pump 20 at an initial stage of engine starting, the air may cause lock pin 33 to be released in unintentional timing, and cause knocking noise due to rattling of vane rotor 9 that receives the alternating torque of camshaft 2.

In view of the foregoing, in the first embodiment, the first cross-sectional area Se of small opening part 41*c* is set greater than or equal to 1 $mm^2$.

This serves to allow the air in retard hydraulic chamber 15 to be exhausted quickly, and thereby allow the relative rotational speed of vane rotor 9 to be set in accordance with the requested speed, without influence on the relative rotational speed of vane rotor 9 in the retard direction.

In the first embodiment, the opening area of small passage part 41*c* is employed as the minimum cross-sectional area of communication passage 41. However, if a throttling portion is provided in communication passage 41 wherein the throttling portion has a cross-sectional area equal or close to the opening area of small opening part 41*c*, the throttling portion may be employed as the minimum cross-sectional area of communication passage 41.

Behavior of First Embodiment

The following briefly describes behavior of the valve timing control device according to the first embodiment.

When an ignition switch is turned off, driving of oil pump 20 is then stopped, so that hydraulic pressure supply to retard hydraulic chambers 15 and advance hydraulic chambers 16 is stopped.

Until the engine is completely stopped, vane rotor 9 is made by the negative component of the alternating torque applied to camshaft 2, to rotate in the retard direction with respect to housing 6 against the spring force of torsion spring 26. Accordingly, as shown in FIG. 4, vane rotor 9 is restricted in the most retarded relative rotational position by contact between first vane 14*a* and the raised portion 11*e* of first shoe 11*a* facing the first vane 14*a*.

At the moment, the tip portion 33*d* of lock pin 33 is engaged in lock hole 31 by the spring force of coil spring 40, thereby locking the vane rotor 9 with respect to housing 6 and preventing free relative rotation.

Thereafter, when the ignition switch is turned on to restart the engine, the engine is started with stabilized starting and enhanced startability, because the opening and closing timings of the intake valve set are retarded during cranking.

At the moment, the tip portion 33*d* of lock pin 33 is maintained engaged in lock hole 31, thereby maintaining the vane rotor 9 locked with respect to housing 6. This suppresses the occurrence of knocking noise by suppression of rattling of vane rotor 9.

Thereafter, as the engine shifts into a region of idling or low load, the control current (pulse current) outputted by the control unit causes electromagnetic switching valve 21 to provide communication between discharge passage 20*a* and retard oil passage 18, and also provide communication between advance oil passage 19 and drain passage 22. Accordingly, the hydraulic pressure discharged from oil pump 20 into discharge passage 20*a* flows into retard hydraulic chambers 15 via retard oil passage 18 and others.

The hydraulic pressure further flows via second unlock passage 34*b* into second pressure-receiving chamber 37, and acts on step face 33*c* of lock pin 33. This causes lock pin 33 to travel backward against the spring force of coil spring 40, so that tip portion 33*d* is brought out of and unlocked from lock hole 31. This quickly ensures free rotation of vane rotor 9.

Simultaneously, the working oil which has flown into one of retard hydraulic chambers 15 flows into communication passage 41, so that air mixed in working oil in communication passage 41 flows via small passage part 41*c* into back pressure chamber 38. The air further flows through exhaust passage 39, and is exhausted to the outside. In this way, the air which has flown into back pressure chamber 38 does not remain in back pressure chamber 38, but is quickly exhausted via exhaust passage 39. This serves to provide smooth slide of lock pin 33 in pin accommodation hole 32, and quick exit of tip portion 33*d* from lock hole 31.

In particular, in the first embodiment, the ratio of first cross-sectional area Se of small opening part 41*c* of communication passage 41 to second cross-sectional area Sv of exhaust passage 39 is set smaller than or equal to 0.18 as described above. This serves to suppress the rise of the back pressure in back pressure chamber 38.

Thereby, tip portion 33*d* of lock pin 33 can exit from lock hole 31 at a speed suitable for the requested speed, even if the unlock pressure supplied from second unlock passage 34*b* to second pressure-receiving chamber 37 is low. This serves to quickly ensure free rotation of vane rotor 9, and thereby enhance the responsiveness of relative rotation control of vane rotor 9.

The feature that the first cross-sectional area (opening area) Se of small opening part 41*c* of communication passage 41 is set greater than or equal to 1 $mm^2$ as described above, serves to sufficiently enhance the exhaust air quantity per unit time into back pressure chamber 38, Q. This allows quick exhaust of air from retard hydraulic chamber 15, and prevents the locking from being released by the air, and suppresses the occurrence of knocking noise due to rattling of vane rotor 9.

Furthermore, at this moment, the working oil in advance hydraulic chambers 16 is drained via advance oil passage 19 and drain passage 22 to oil pan 23.

This enhances the internal pressure of each retard hydraulic chamber 15, and reduces the internal pressure of each advance hydraulic chamber 16. Accordingly, as shown in FIG. 4, vane rotor 9 rotates relatively in the counterclockwise direction (in the retard direction) so that the first side face of first vane 14*a* gets in contact with the opposite raised portion of first shoe 11*a*, and vane rotor 9 is thereby restricted in the most retarded relative rotational position.

This serves to provide no valve overlap between the intake valve set and the exhaust valve set, and suppress blowback of burned gas, and achieve a preferable state of combustion, and enhance the fuel efficiency and stabilize rotation of the engine.

Thereafter, when the engine operating state shifts into the middle load region, the control current outputted by the control unit causes electromagnetic switching valve 21 to provide communication between discharge passage 20*a* and advance oil passage 19, and also provide communication between retard oil passage 18 and drain passage 22. Accordingly, the hydraulic pressure discharged from oil pump 20 into discharge passage 20*a* flows into advance hydraulic chambers 16 via advance oil passage 19.

Furthermore, this hydraulic pressure flows via first unlock passage 34*a* into first pressure-receiving chamber 36, and acts on tip portion 33*d* of lock pin 33. Accordingly, lock pin 33 is made to travel backward against the spring force of coil spring 40, so that tip portion 33*d* is maintained out of lock hole 31.

At this moment, the working oil in retard hydraulic chambers 15 is drained via retard oil passage 18 and drain passage 22 to oil pan 23. This enhances the internal pressure of each advance hydraulic chamber 16, and reduces the internal pressure of each retard hydraulic chamber 15.

Accordingly, as shown in FIG. 5, vane rotor 9 rotates relatively in the clockwise direction (in the advance direction) so that the second side face of first vane 14*a* gets in contact with the opposite raised portion 11*f* of second shoe 11*b*, and vane rotor 9 is thereby restricted in the most advanced relative rotational position.

This increases the valve overlap between the intake valve set and the exhaust valve set, and reduces the combustion temperature, and reduces NOx in exhaust gas. This also burns unburned gas, and thereby reduces NOx in exhaust gas.

When the engine operating state changes in other manners, the relative rotational position of vane rotor 9 with respect to housing 6 may be varied freely by the control unit and electromagnetic switching valve 21 and others. This allows the opening and closing timings of the intake valve set to be changed arbitrarily, and thereby allows full performance of the engine such as fuel efficiency and output power to be achieved.

The further feature of the first embodiment that communication passage 41 and second unlock passage 34*b* are arranged in parallel to each other, and equal in inside diameter to each other, serves to make it easy to form the communication passage 41 and second unlock passage 34*b*. Namely, if these are formed by drill forming, these can be easily formed by one drill in one direction.

The further feature of the first embodiment that second end opening 41*b* of communication passage 41 has a non-circular shape, i.e. a crescent shape, results in a longer circumference as compared to one having a circular cross-section. This enhances the resistance of fluid flow. This is more influential on working oil than on air, because the working oil is more viscous. As a result, working oil is resistant to flow through second end opening 41*b*, and air easily flows through second end opening 41*b*. This enhances the performance of air exhaust.

In the first embodiment, the spring force of torsion spring 26 is employed to apply a slight biasing force to vane rotor 9 against the relatively large negative component of the alternating torque acting in the retard direction. This serves to suppress the influence of the negative torque on vane rotor 9, and allow the relative rotation control of vane rotor 9 in the advance direction and in the retard direction to be performed accurately.

Second Embodiment

Figure 13:
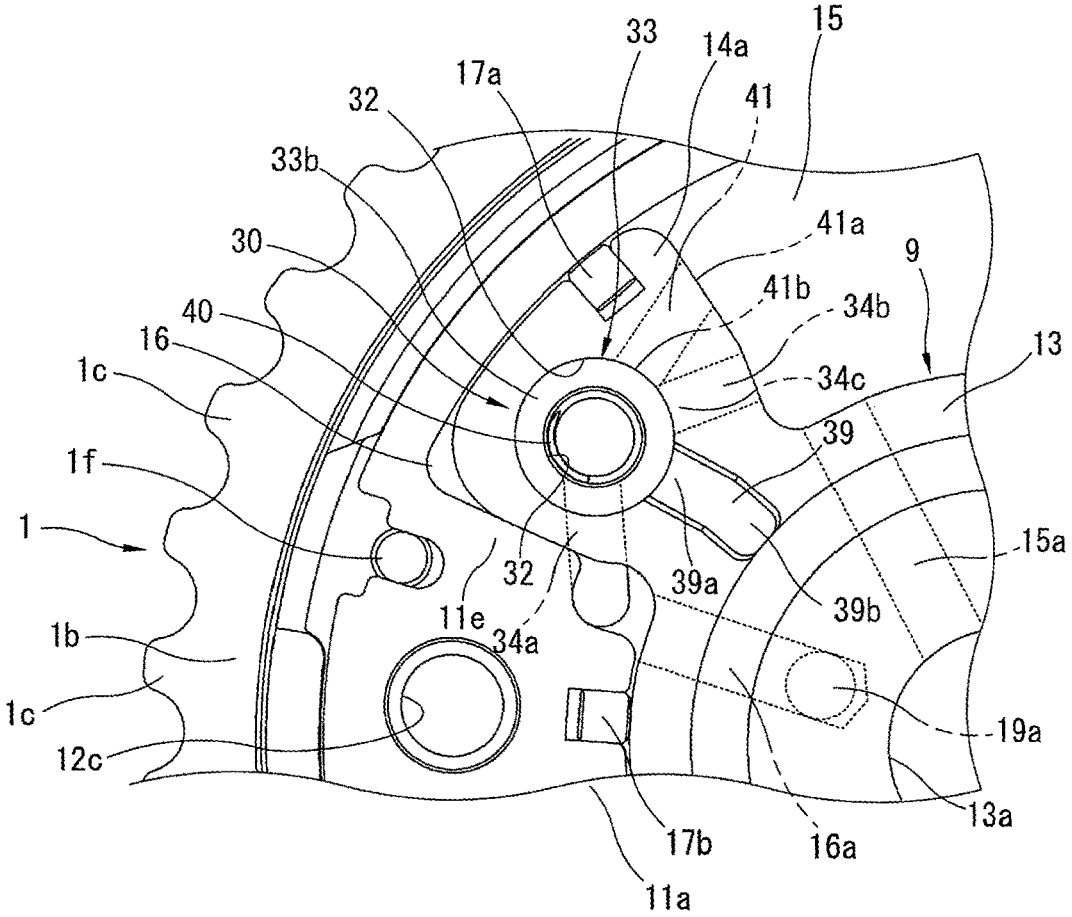
FIG. 13 is an enlarged front view of a lock mechanism according to a second embodiment of the present invention.
Figure 14:
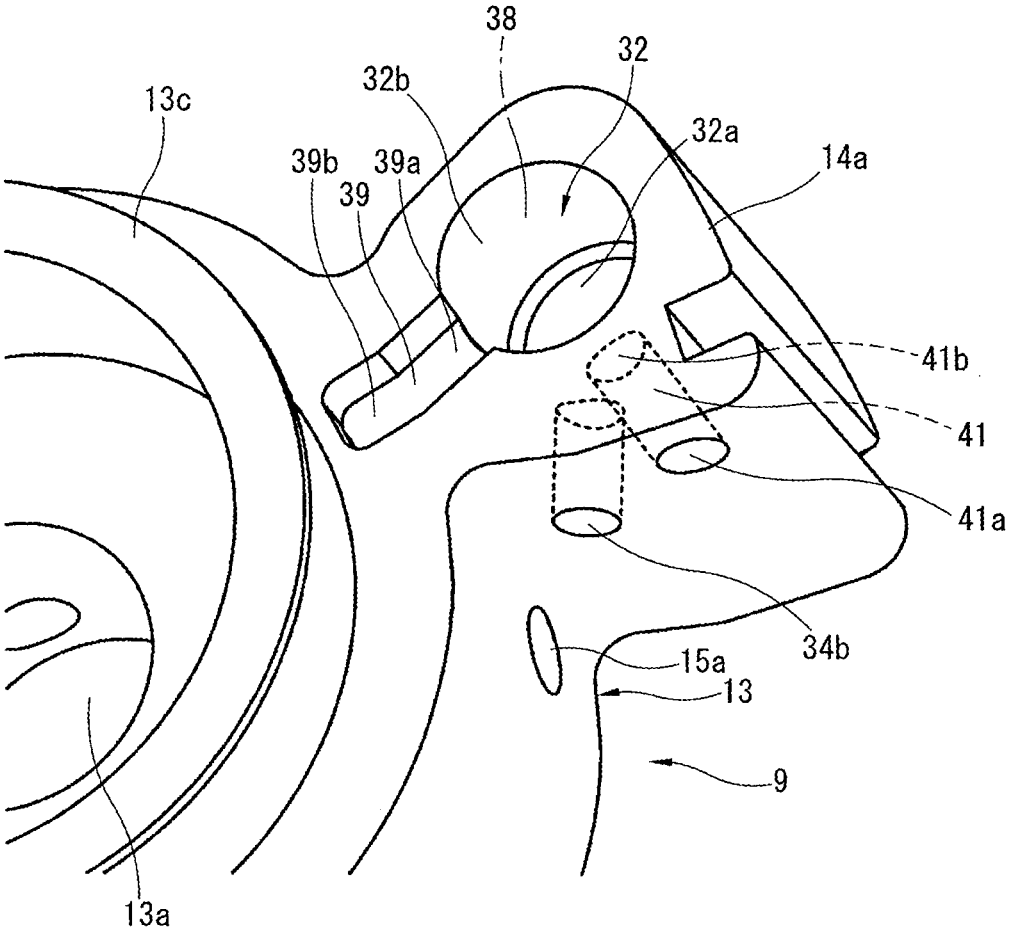
FIG. 14 is an enlarged perspective view of the lock mechanism according to the second embodiment.

FIGS. 13 and 14 show a second embodiment. FIG. 13 is an enlarged front view of lock mechanism 30. FIG. 14 is an enlarged perspective view of lock mechanism 30.

In this embodiment, the position of second unlock passage 34*b* with respect to first vane 14*a* is the same as in the first embodiment, but the position of communication passage 41 is inclined outward with respect to second unlock passage 34*b*.

Specifically, communication passage 41 is structured such that in a radial direction of a rotating shaft of vane rotor 9, second end opening 41*b* facing the back pressure chamber 38 is located outside of second end opening part 34*c* of second unlock passage 34*b* facing the back pressure chamber 38. Furthermore, communication passage 41 has an attitude inclined from second end opening 41*b* outward in the radial direction of first vane 14*a*. Accordingly, first end opening 41*a* facing the retard hydraulic chamber 15 is directed toward the inner peripheral face of housing body 7.

Employment of this structure serves to enlarge the length of sealing with second end opening part 34*c* of second unlock passage 34*b*.

The other configuration is the same as in the first embodiment.

Third Embodiment

Figure 15:
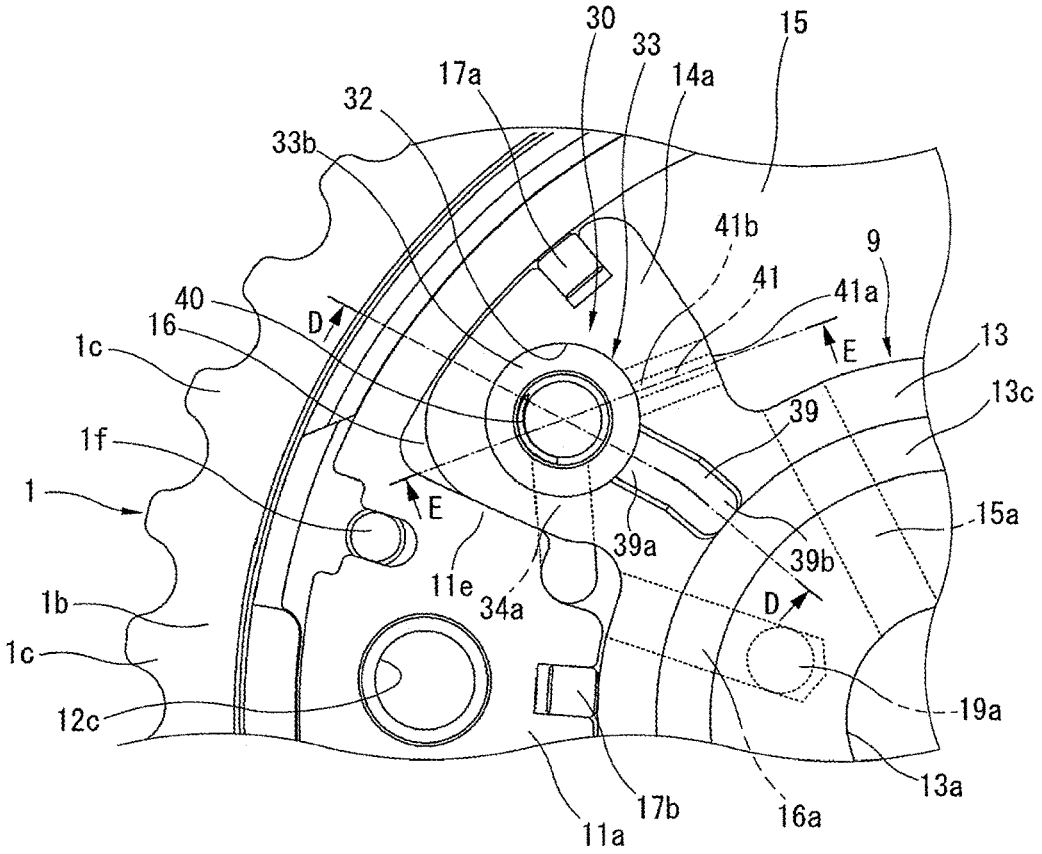
FIG. 15 is an enlarged front view of a lock mechanism according to a third embodiment of the present invention.

FIGS. 15-17 show a third embodiment, where the third embodiment differs from the first embodiment in that the inside diameter of communication passage 41 is set small, and arrangement of communication passage 41 is modified.

Specifically, communication passage 41 is arranged parallel to the longitudinal direction of second unlock passage 34*b*, and is apart from the position of second unlock passage 34*b* and closer to front plate 10.

Communication passage 41 has a small circular hole (small hole) substantially uniform in the longitudinal direction, wherein the first cross-sectional area Se of communication passage 41 is set equal or close to about 1 $mm^2$ as in the first embodiment. Furthermore, regarding the relationship between unlock pressure Pr and the ratio between the first cross-sectional area Se of communication passage 41 and the second cross-sectional area Sv of exhaust passage 39, the ratio Se/Sv is set smaller than or equal to 0.18 as in the first embodiment. Communication passage 41 is structured such that first end opening 41*a* faces the retard hydraulic chamber 15, and when lock pin 33 is inserted in lock hole 31, second end opening 41*b* faces the back pressure chamber 38.

Figure 16A:
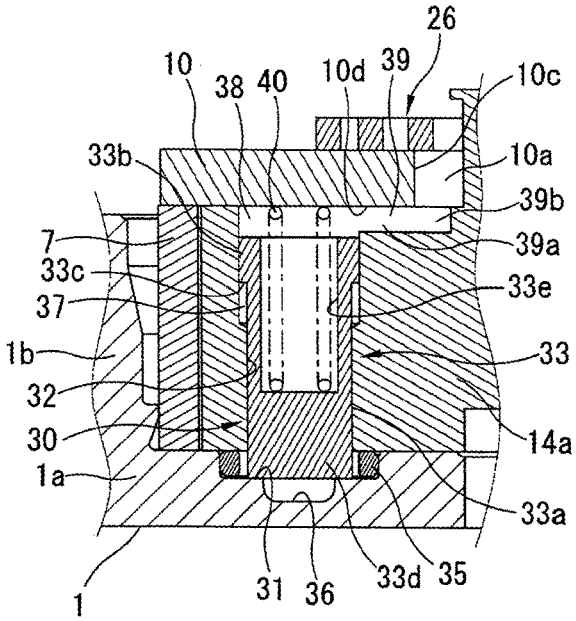
FIG. 16A is a sectional view taken along a line D-D in FIG. 15.
Figure 16B:
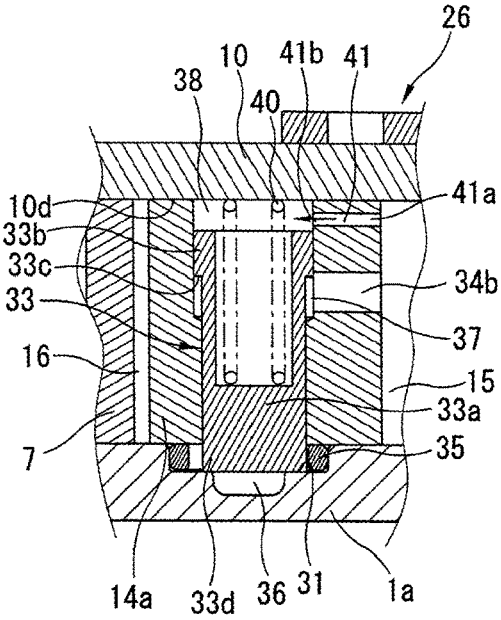
FIG. 16B is a sectional view taken along a line E-E in FIG. 15.

As shown in FIGS. 16A and 16B, when tip portion 33*d* of lock pin 33 is engaged in lock hole 31 by the spring force of coil spring 40, second end opening 41*b* of communication passage 41 communicates with back pressure chamber 38 via the rear end of flange 33*b*. Back pressure chamber 38 communicates with exhaust passage 39.

Accordingly, the working oil supplied to retard hydraulic chamber 15 partially flows from second unlock passage 34*b* into second pressure-receiving chamber 37, whereas the air mixed in the working oil is separated and flows via communication passage 41 into back pressure chamber 38, and is thereafter exhausted quickly via exhaust passage 39 to the outside.

The feature that the first cross-sectional area Se of second end opening 41*b* of communication passage 41 is specially configured as described above, serves to enhance the performance of exhausting air from communication passage 41 into back pressure chamber 38, and exhausting air from back pressure chamber 38. Thereby, the second embodiment produces similar advantageous effects as in the first embodiment.

Figure 17A:
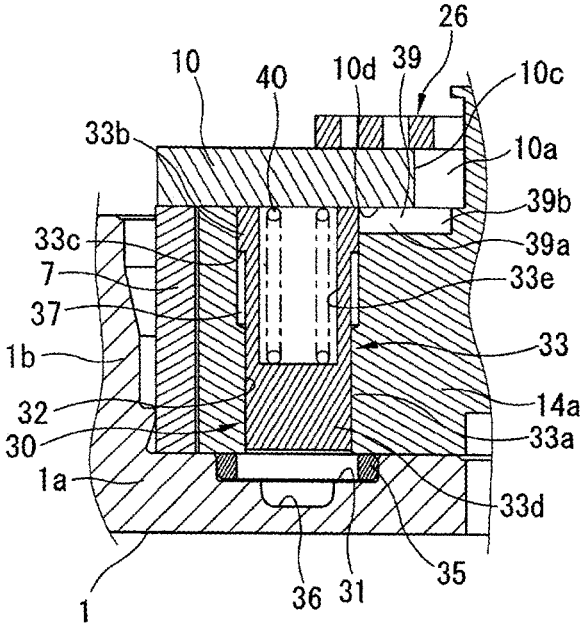
FIG. 17A is a sectional view taken along a line D-D in FIG. 15.
Figure 17B:
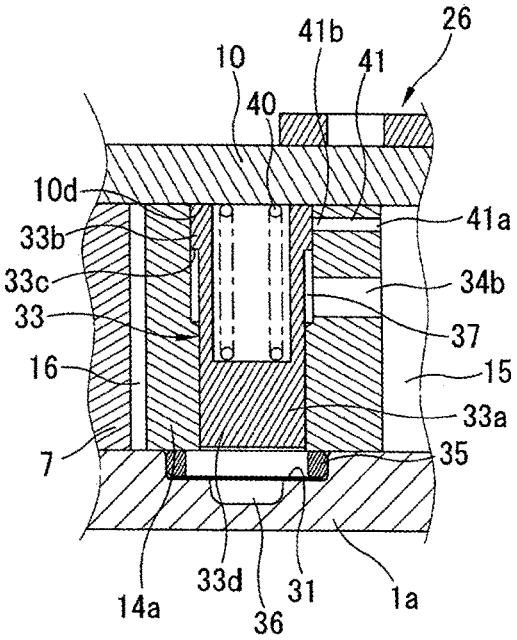
FIG. 17B is a sectional view taken along a line E-E in FIG. 15.

Next, as shown in FIGS. 17A and 17B, when lock pin 33 is made to travel backward maximally against the spring force of coil spring 40 by the working oil pressure supplied to second pressure-receiving chamber 37 so that tip portion 33*d* gets out of lock hole 31, the outer peripheral face of flange 33*b* closes the second end opening 41*b* of communication passage 41, and simultaneously closes the upstream opening 39*a* of exhaust passage 39. This ensures free relative rotation of vane rotor 9.

The feature of the third embodiment that the diameter of the whole of communication passage 41 is set small, serves to allow the outer peripheral face of flange 33*b* to close second end opening 41*b* sufficiently, and enlarge the length of sealing with the opening of second unlock passage 34*b*.

The further feature that communication passage 41 is a small hole serves to ensure a large area of sealing between the outer periphery of flange 33*b* and the inner periphery of pin accommodation hole 32, and thereby prevent working oil from being leaked therebetween.

Fourth Embodiment

FIGS. 18 to 21 show a fourth embodiment, in which both of second unlock passage 34*b* and communication passage 41 are implemented by a single passage hole 42 having a large diameter.

Figure 18:
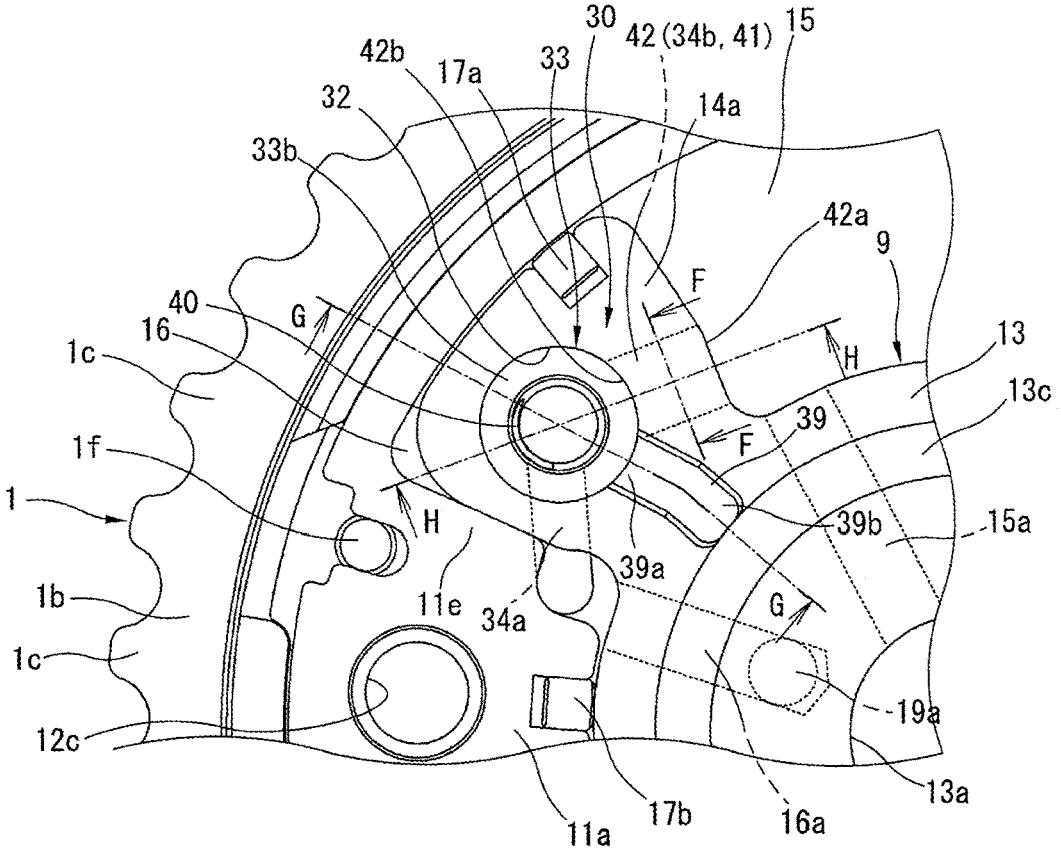
FIG. 18 is an enlarged front view of a lock mechanism according to a fourth embodiment of the present invention.
Figure 19:
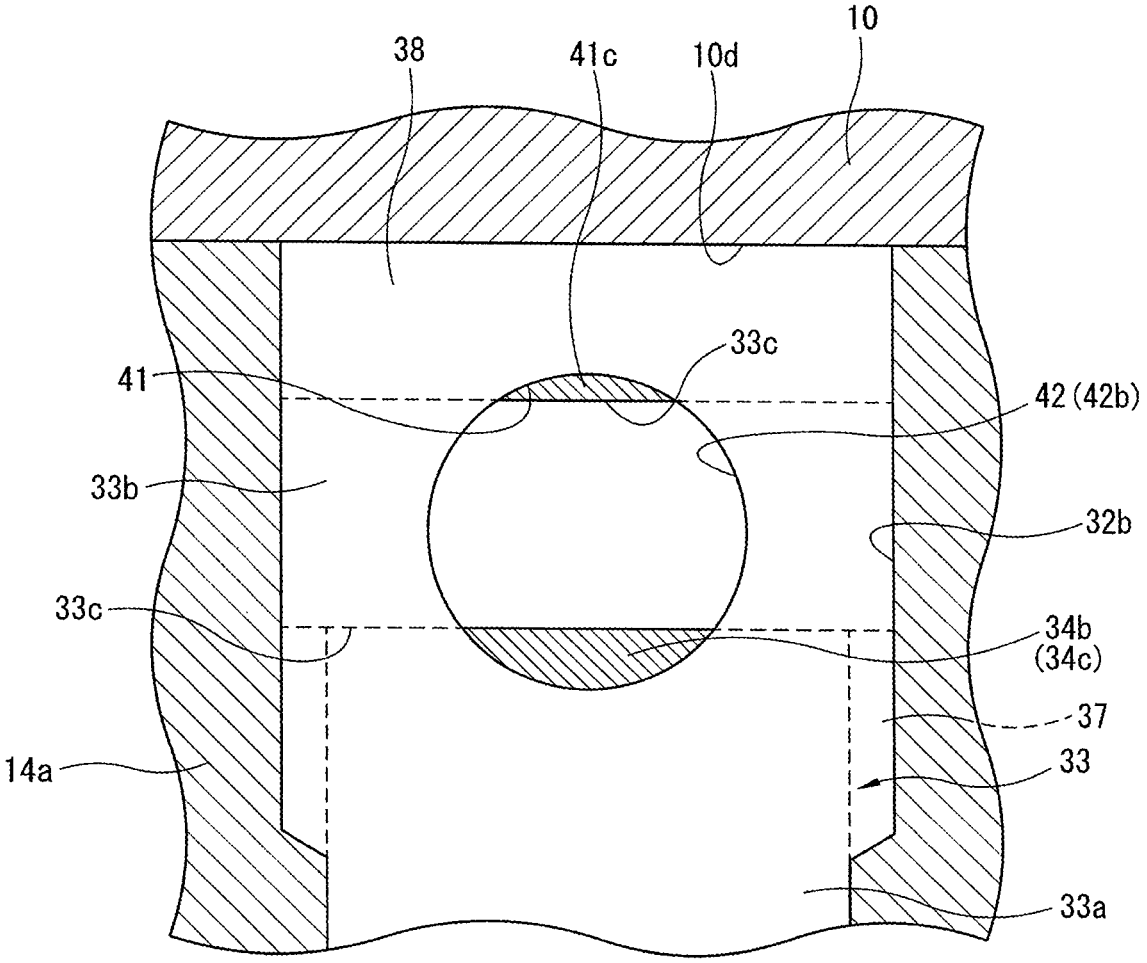
FIG. 19 is a sectional view taken along a line F-F in FIG. 18.

As shown in FIGS. 18 and 19, passage hole 42 is formed to have a relatively large diameter. In FIG. 19, passage hole 42 includes a lower part serving as second unlock passage 34*b*, and an upper part serving as communication passage 41.

As shown in FIG. 19, passage hole 42 has a diameter greater than the width of flange 33*b* of lock pin 33 in its longitudinal direction, wherein a first end opening 42*a* is opened to retard hydraulic chamber 15, and as indicated by hatching pattern, a second end opening 42*b* is opened to pin accommodation hole 32, on upper and lower sides of flange 33*b*.

Figure 20A:
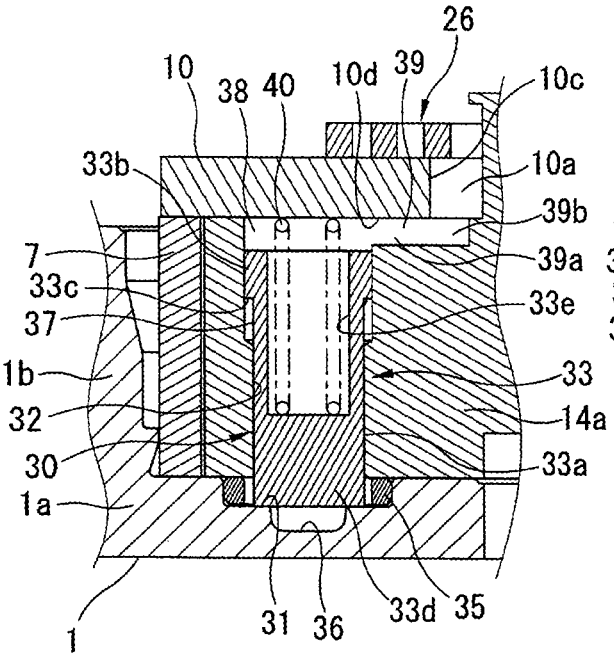
FIG. 20A is a sectional view taken along a line G-G in FIG. 18.
Figure 20B:
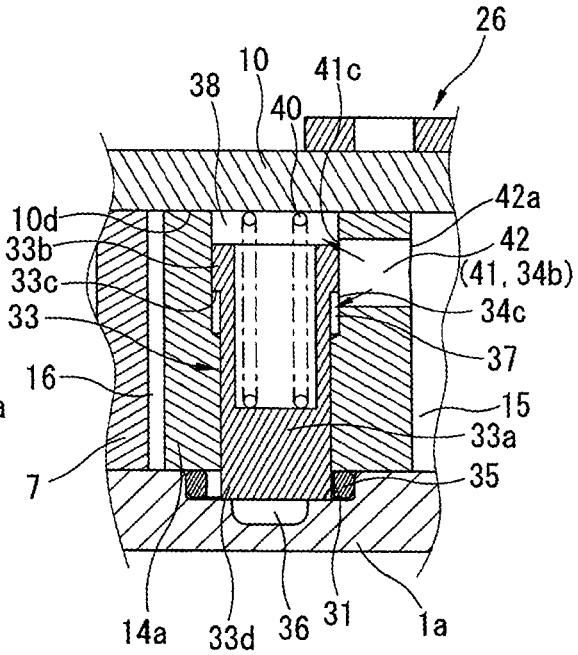
FIG. 20B is a sectional view taken along a line H-H in FIG. 18.

Specifically, as shown in FIG. 20B, when lock pin 33 is engaged in lock hole 31, a portion (throttling portion) of the lower end part of second end opening 42*b* of passage hole 42 defined by flange 33*b* faces second pressure-receiving chamber 37, whereas a portion (throttling portion) of the lower end part of second end opening 42*b* defined by flange 33*b* faces back pressure chamber 38.

Regarding the second unlock passage 34*b* and communication passage 41, when tip portion 33*d* of lock pin 33 is engaged in lock hole 31, second unlock passage 34*b* is defined in the lower part of passage hole 42 in FIG. 19, and a part 34*c* of the second opening of passage hole 42 facing the pin accommodation hole 32 (part of the downstream side of passage hole 42) faces second pressure-receiving chamber 37 via flange 33*b*. Second end opening part 34*c* has a crescentic shape defined by the lower end edge of flange 33*b* as indicated by hatching pattern.

On the other hand, communication passage 41 is defined in the upper part of passage hole 42 in FIG. 19, small passage part 41*c* of the second opening of passage hole 42 facing the pin accommodation hole 32 (part of the downstream side of passage hole 42) faces back pressure chamber 38 via flange 33*b*. Small opening part 41*c* has a crescentic shape as indicated by hatching pattern, and has an opening area that is less than the opening area of second end opening part 34*c* of second unlock passage 34*b*.

Accordingly, under this condition, small passage part 41*c* of communication passage 41 communicates with exhaust passage 39 via back pressure chamber 38 as shown in FIGS. 20A and 20B.

Under this condition, the first cross-sectional area Se of small opening part 41*c* of communication passage 41 is set greater than or equal to about 1 $mm^2$ as in the first embodiment, and regarding the relationship between the unlock pressure and the ratio of the first cross-sectional area Se to the second cross-sectional area Sv of exhaust passage 39, the ratio Se/Sv is set less than or equal to 0.18.

Accordingly, when tip portion 33*d* of lock pin 33 is inserted in lock hole 31, the air mixed in the working oil supplied to retard hydraulic chamber 15 is separated and flows via small passage part 41*c* into back pressure chamber 38 as indicated by an arrow in FIG. 20B, and is thereafter exhausted quickly via exhaust passage 39 to the outside.

The feature that the first cross-sectional area (open cross-sectional area) Se of small opening part 41*c* is specially configured as described above, serves to improve the performance the performance of exhausting air via small passage part 41*c* into back pressure chamber 38, and exhausting air via exhaust passage 39 from back pressure chamber 38 to the outside. Thereby, the fourth embodiment produces similar advantageous effects as in the first embodiment.

When the air mixed in the working oil in retard hydraulic chamber 15 flows via small opening part 41*c* into back pressure chamber 38, a part of the working oil simultaneously flows via second end opening part 34*c* of second unlock passage 34*b* into second pressure-receiving chamber 37.

The further feature of the fourth embodiment that both of second unlock passage 34*b* and communication passage 41 are implemented by the single passage hole 42, requires only one drilling operation, so that the forming operation becomes very easy. The feature that passage hole 42 is formed to have a large diameter, serves to enhance the efficiency of drilling operation while ensuring the accuracy of hole formation.

Figure 21A:
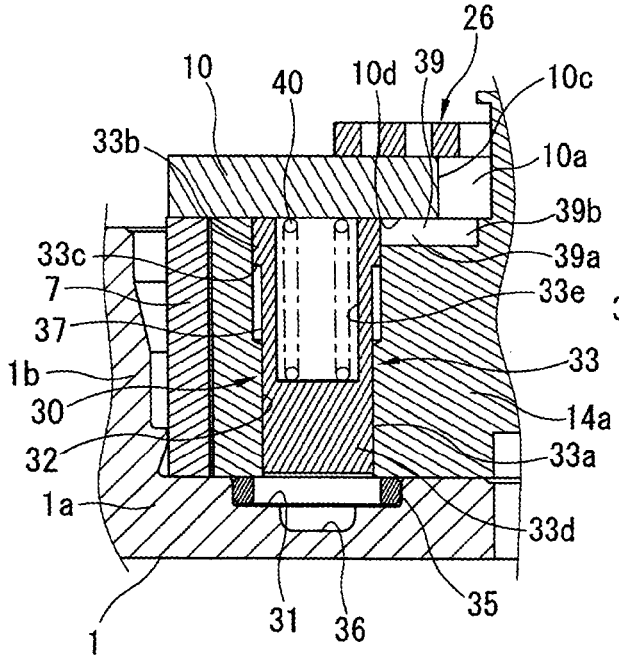
FIG. 21A is a sectional view taken along a line G-G in FIG. 18.
Figure 21B:
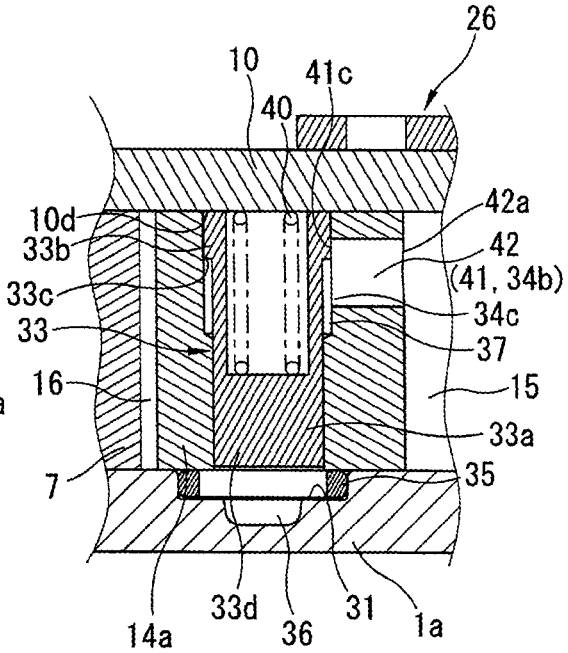
FIG. 21B is a sectional view taken along a line H-H in FIG. 18.

Furthermore, the opening area of small passage part 41*c* of communication passage 41 is smaller than that of second end opening part 34*c* of second unlock passage 34*b*. Accordingly, as shown in FIGS. 21A and 21B, when lock pin 33 is out of lock hole 31, it is possible to provide a sufficiently large sealing area between the outer periphery of flange 33*b* and the inner periphery of pin accommodation hole 32. The enlarged sealing area serves to suppress the working oil from being leaked from retard hydraulic chamber 15 into back pressure chamber 38.

Fifth Embodiment

Figure 22:
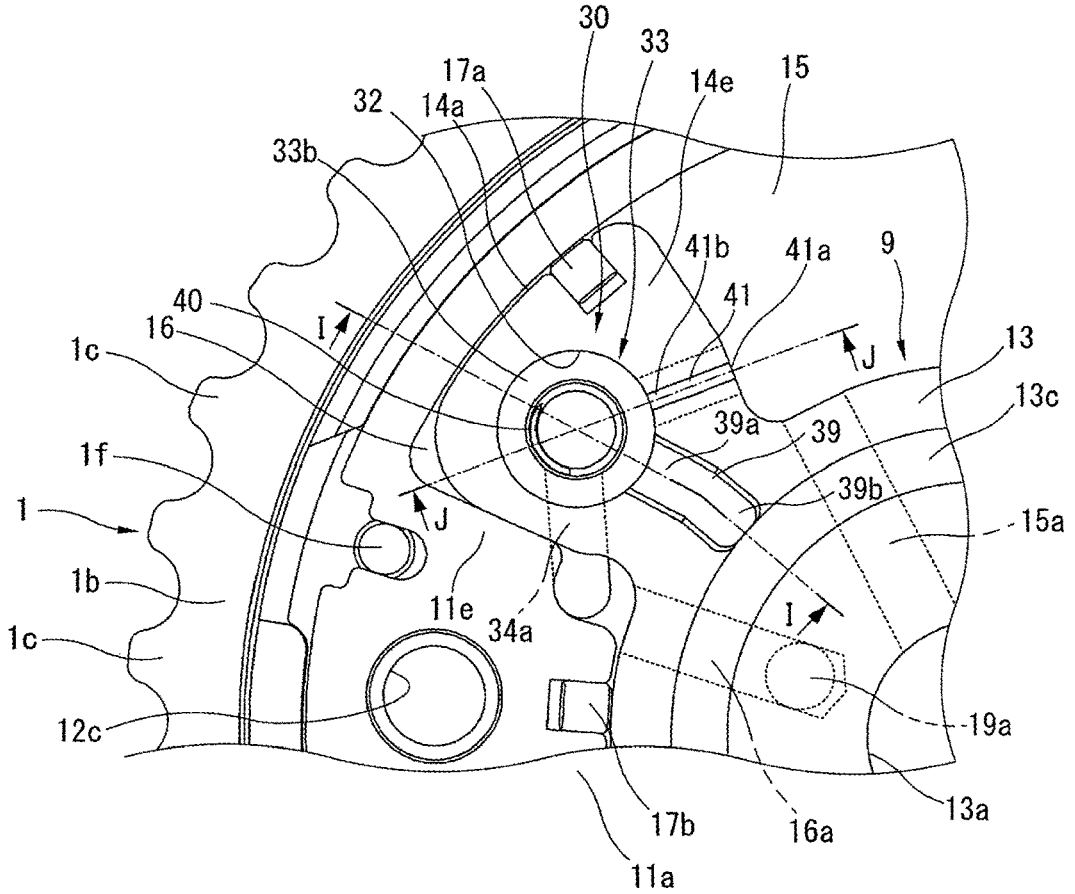
FIG. 22 is an enlarged front view of a lock mechanism according to a fifth embodiment of the present invention.

FIGS. 22 to 24 show a fifth embodiment, in which the position and size of second unlock passage 34*b* are the same as in the first embodiment, but communication passage 41 is formed in the outer end face of first vane 14*a*.

Specifically, communication passage 41 is formed in the first end face of first vane 14*a* in the axial direction, namely, is formed in outer end face 14*e* of first vane 14*a* closer to front plate 10, and is parallel to second unlock passage 34*b*. Communication passage 41 is formed between a straight groove and inner end face 10*d* of front plate 10 that covers the groove.

Figure 23A:
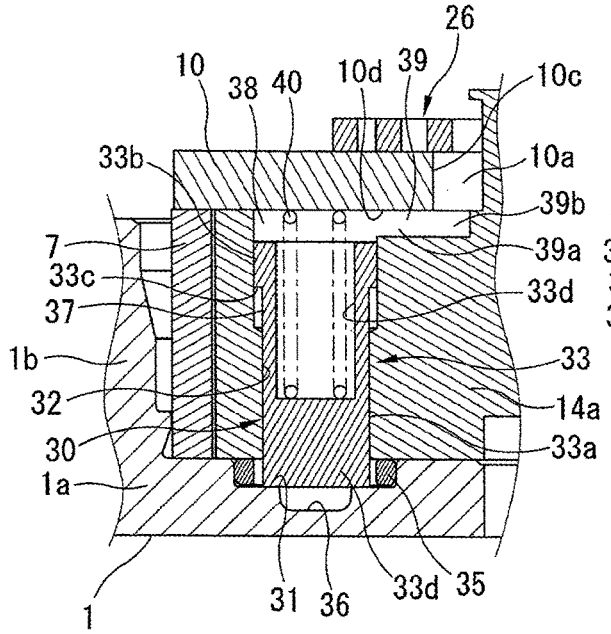
FIG. 23A is a sectional view taken along a line I-I in FIG. 22.
Figure 23B:
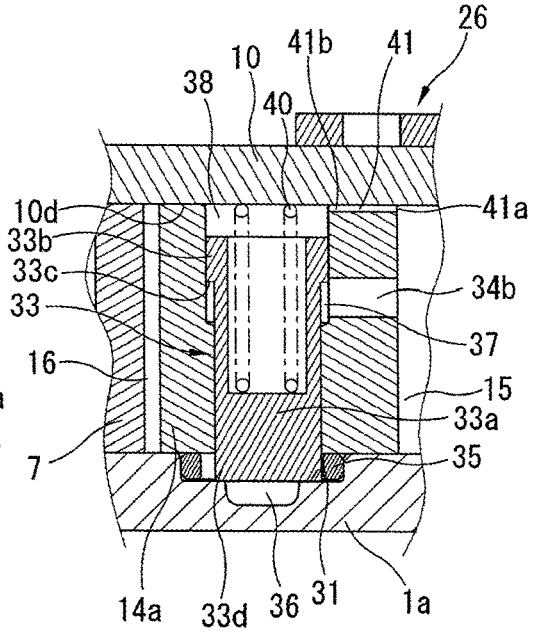
FIG. 23B is a sectional view taken along a line 3-3 in FIG. 22.

Communication passage 41 is structured such that when lock pin 33 is engaged in lock hole 31, first end opening 41*a* faces retard hydraulic chamber 15, and second end opening 41*b* faces back pressure chamber 38 as shown in FIGS. 23A and 23B. In this state, back pressure chamber 38 communicates with exhaust passage 39.

As in the first embodiment, the first cross-sectional area Se of communication passage 41 is set greater than or equal to 1 $mm^2$, and regarding the relationship between the unlock pressure and the ratio of the first cross-sectional area Se to the second cross-sectional area Sv of exhaust passage 39, the ratio Se/Sv is set less than or equal to 0.18. Thereby, the fifth embodiment produces the same advantageous effects as in the first embodiment.

Figure 24A:
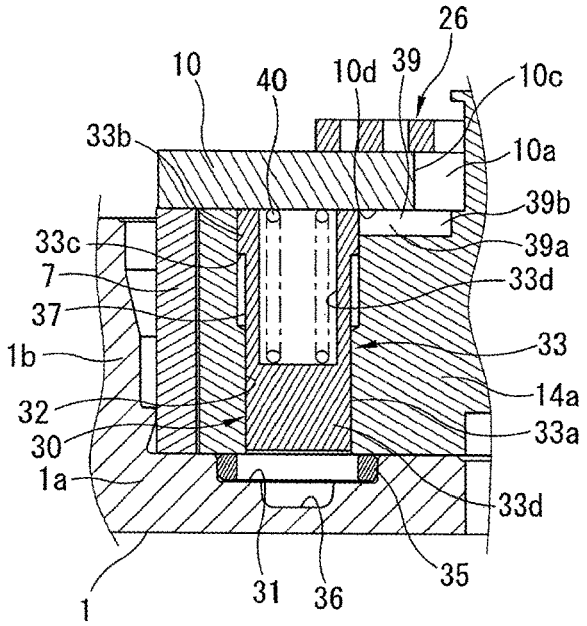
FIG. 24A is a sectional view taken along a line I-I in FIG. 22.
Figure 24B:
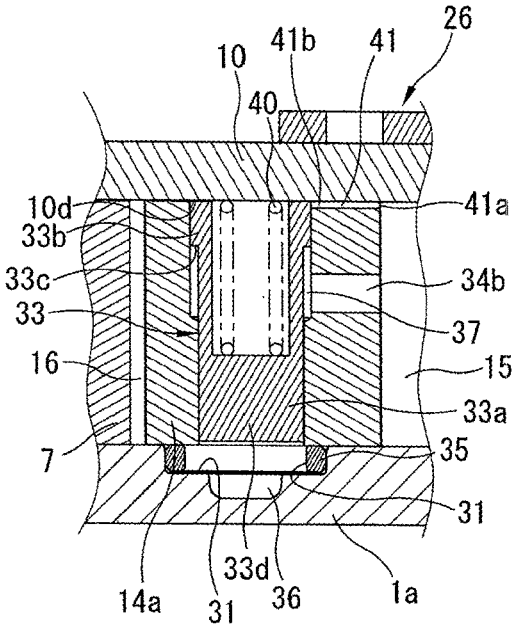
FIG. 24B is a sectional view taken along a line 3-3 in FIG. 22.

As shown in FIGS. 24A and 24B, when lock pin 33 is out of lock hole 31, the outer peripheral face of flange 33*b* of lock pin 33 closes second end opening 41*b* of communication passage 41 and upstream opening 39*a* of exhaust passage 39.

The further feature of the fifth embodiment that the diameter of the entire communication passage 41 is set small, serves to allow the outer peripheral face of flange 33*b* to close second end opening 41*b* sufficiently, and enlarge the length of sealing with the opening of second unlock passage 34*b*, as in the third embodiment.

The further feature that communication passage 41 is implemented by a groove, serves to ensure a large area of sealing between the outer periphery of flange 33*b* and the inner periphery of pin accommodation hole 32, and thereby prevent working oil from being leaked therebetween.

Since during formation of vane rotor 9 by sintering in a mold, communication passage 41 can be simultaneously formed in outer end surface 14*e* of first vane 14*a*, manufacturing operation is very easy as compared to cases where communication passage 41 is drilled by a following operation.

Sixth Embodiment

Figure 25:
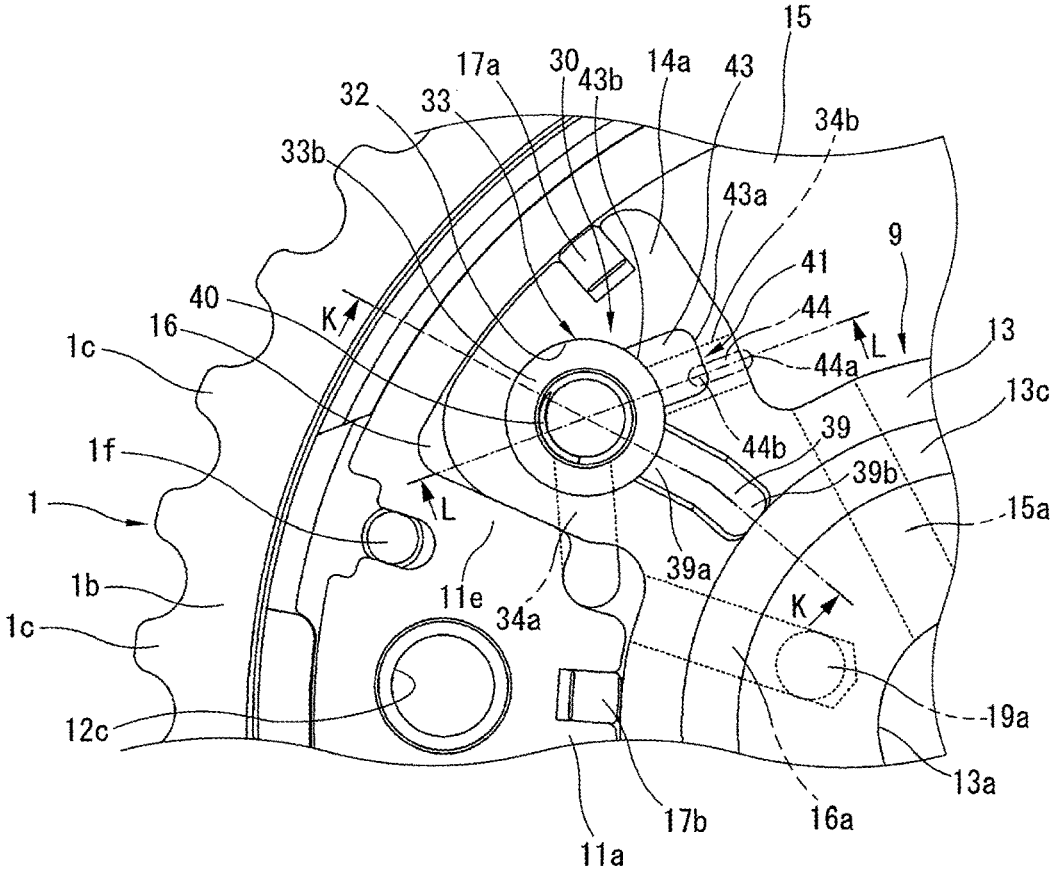
FIG. 25 is an enlarged front view of a lock mechanism according to a sixth embodiment of the present invention.
Figure 26A:
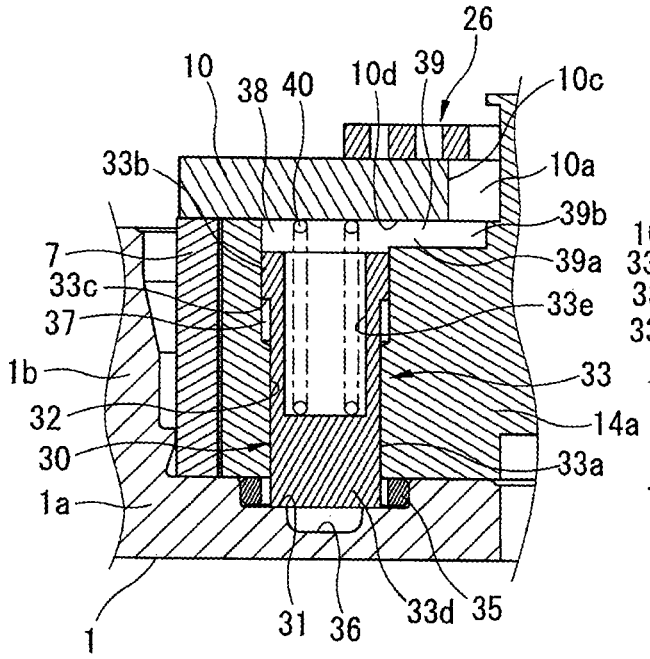
FIG. 26A is a sectional view taken along a line K-K in FIG. 25.
Figure 26B:
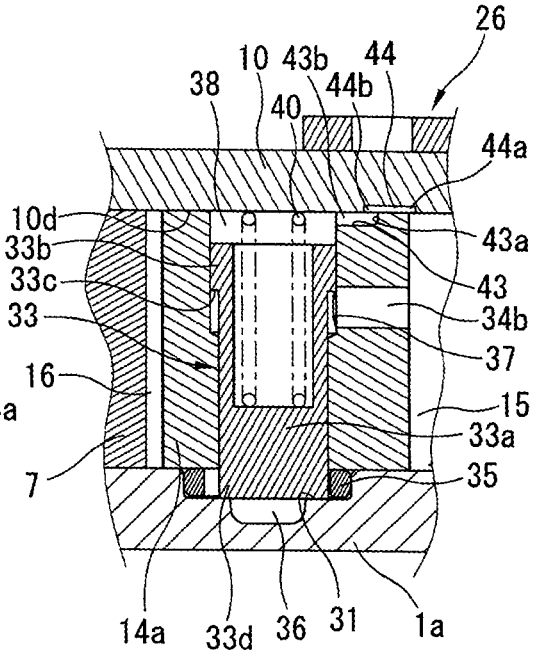
FIG. 26B is a sectional view taken along a line L-L in FIG. 25.
Figure 27A:
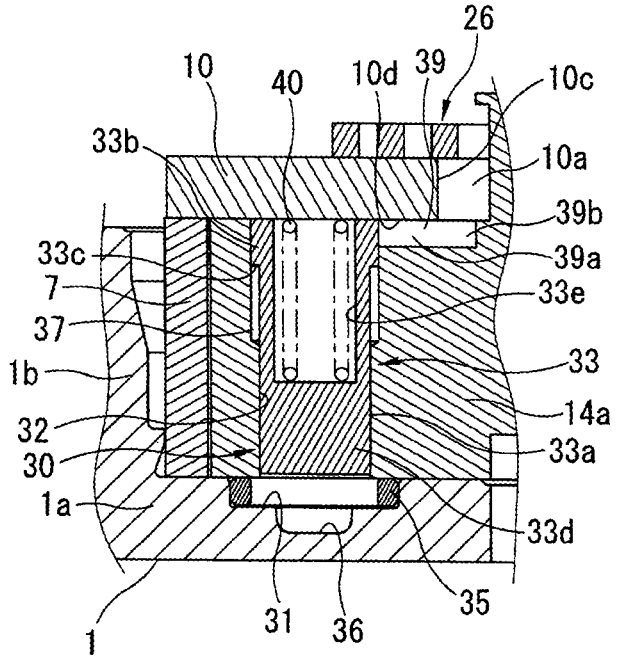
FIG. 27A is a sectional view taken along a line K-K in FIG. 25.

FIGS. 25 to 27 show a sixth embodiment, in which second unlock passage 34*b* is structured as in the first embodiment, but communication passage 41 is formed in both of outer end face 14*e* of first vane 14*a* and inner end face 10*d* of front plate 10.

Specifically, communication passage 41 is formed between outer end face 14*e* of first vane 14*a* and inner end face 10*d* of front plate 10 on which outer end face 14*e* slides, and is composed of a first recess 43 having a first end opened to back pressure chamber 38, and a second recess 44 formed in inner end face 10*d* of front plate 10.

As shown in FIG. 25, first recess 43 has a rectangular shape having a width greater than the inside diameter of second unlock passage 34*b*, wherein first end 43*a* is closed and second end opening 43*b* faces back pressure chamber 38.

On the other hand, second recess 44 is formed by press forming to have a narrow shape having a width that is substantially constant and smaller than the inside diameter of second unlock passage 34*b*, wherein first end opening 44*a* faces retard hydraulic chamber 15. When overlapping with first recess 43, second end opening 44*b* communicates with first end 43*a* of first recess 43.

Figure 27B:
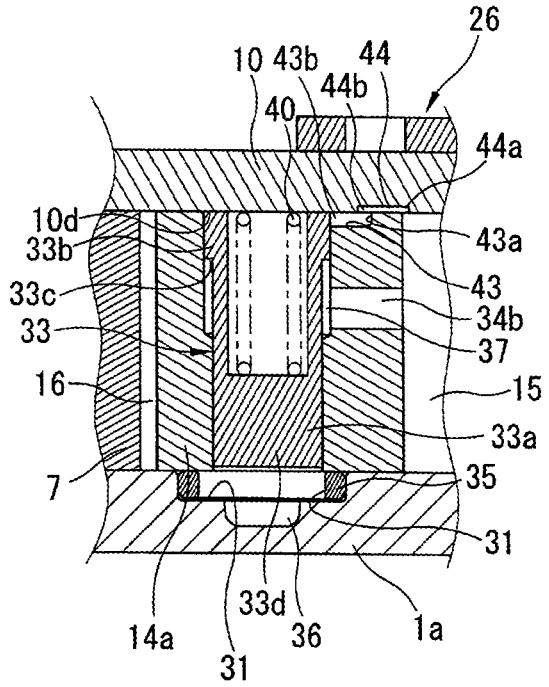
FIG. 27B is a sectional view taken along a line L-L in FIG. 25.

In this way, first recess 43 and second recess 44 communicate with each other by overlap between the first end 43*a* side of first recess 43 and the second end opening 44*b* side of second recess 44, only when vane rotor 9 is rotated into the most retarded position as described above. Namely, when vane rotor 9 is maintained into the most retarded position, for example, when lock pin 33 is engaged in lock hole 31, first recess 43 and second recess 44 overlap each other as shown in FIGS. 26B and 27B.

However, as vane rotor 9 relatively rotates in the advance direction by a specific angle from that state, first recess 43 deviates in position from second recess 44 in the circumferential direction, and becomes apart from second recess 44, so that the overlapping state is canceled and no communication is provided between first recess 43 and second recess 44.

Regarding the second recess 44, the first cross-sectional area Se as the minimum cross-sectional area of second recess 44 is set greater than or equal to 1 $mm^2$, and regarding the relationship between the unlock pressure and the ratio of the first cross-sectional area Se to the second cross-sectional area Sv of exhaust passage 39, the ratio Se/Sv is set less than or equal to 0.18. Thereby, the sixth embodiment produces the same advantageous effects as in the first embodiment.

The difference in cross-sectional area between first recess 43 and second recess 44 serves to effectively exhaust into back pressure chamber 38 the air that is mixed in the working oil in retard hydraulic chamber 15.

Specifically, the air that has flown from retard hydraulic chamber 15 into second recess 44 flows into first recess 43 that is larger in cross-sectional area (volumetric capacity), and then flows into back pressure chamber 38, while spreading with a reduction in flow rate. This allows the air to be exhausted fully into back pressure chamber 38.

The special feature that second recess 44 is formed in the inner side of first vane 14*a* in the radial direction, serves to improve the performance of air trap. Since the working oil moves to the outer side of first vane 14*a* in the radial direction under a centrifugal force, while the air small in specific gravity tends to be collected at the inner side of first vane 14*a*, second recess 44, which is located at the inner side in the radial direction, is enabled to easily collect the air. This enhances the performance of exhausting the air.

Second recess 44 is formed by press forming, simultaneously when front plate 10 is formed by a press machine. This serves to form a groove having a small width with high precision, as compared to sintering formation. This allows the open cross-sectional area of second recess 44 to be adjusted easily and accurately. This serves to obtain an accurate open cross-sectional area, and suppress the manufacturing cost from rising.

First recess 43 of vane rotor 9 may be made of a metal material by sintering formation, and may have a relatively rough shape.

The feature that no communication is provided between first recess 43 and second recess 44 when vane rotor 9 is relatively rotated in the advance direction, serves to suppress the working oil from being leaked via a side clearance between vane rotor 9 and front plate 10 to the outside.

Seventh Embodiment

Figure 28:
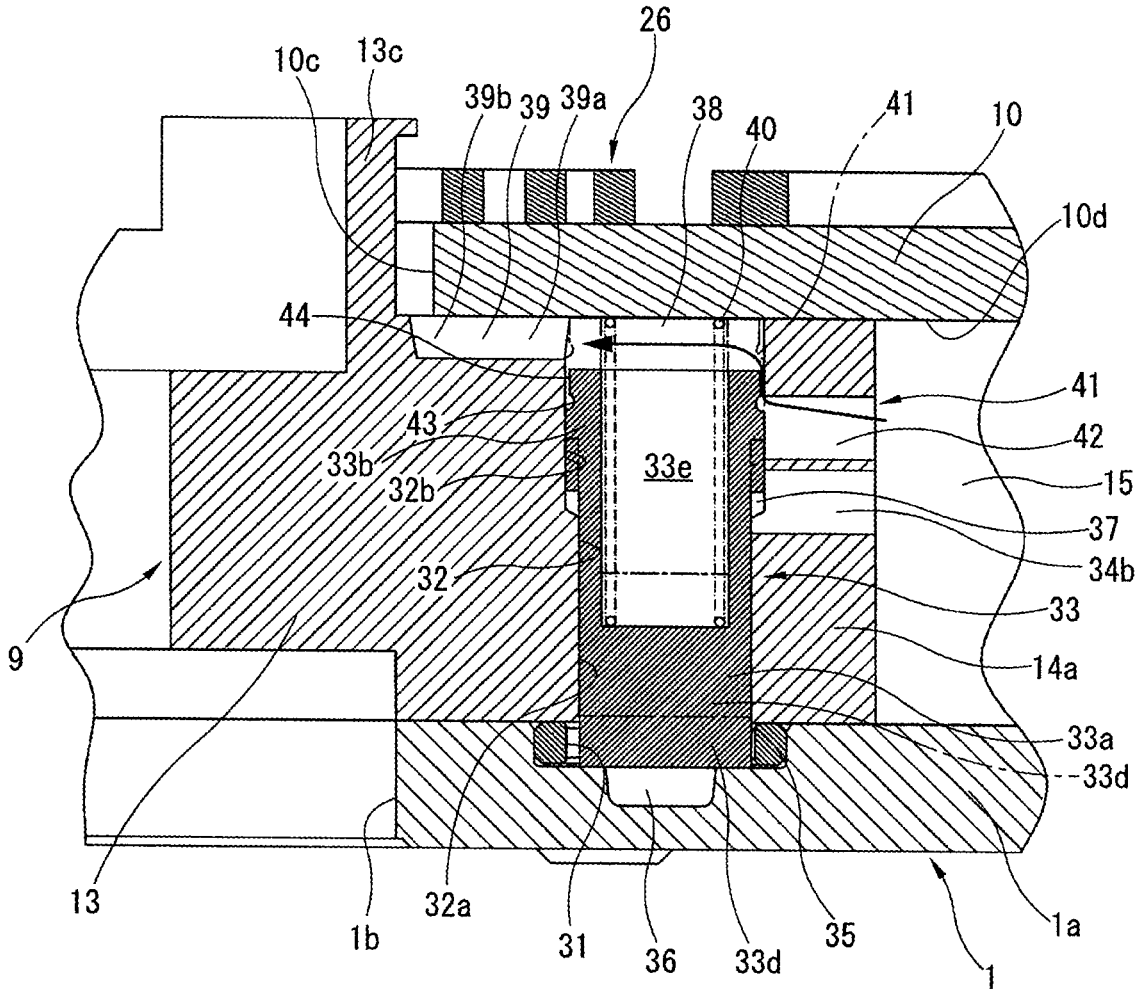
FIG. 28 is a longitudinal sectional view of a lock mechanism according to a seventh embodiment of the present invention in a state that a lock pin is inserted in a lock hole.

FIG. 28 shows a seventh embodiment, in which the location and configuration of communication passage 41 are modified.

Specifically, communication passage 41 includes: a passage hole 42 located on the upper side of second unlock passage 34*b* in FIG. 28, and parallel to second unlock passage 34*b*; and a first recess 43 and a second recess 44 formed in the outer peripheral face of flange 33*b* of lock pin 33.

Passage hole 42 includes an upstream end opened to one of retard hydraulic chambers 15, and a downstream end opened in larger-diameter hole section 32*b* of pin accommodation hole 32. Passage hole 42 has a circular cross-section taken along a plane in its radial direction, which has a substantially constant diameter, wherein the cross-sectional area of passage hole 42 is set substantially equal to that of second unlock passage 34*b*.

Each of first recess 43 and second recess 44 formed in the outer peripheral face of flange 33*b* of lock pin 33 has an annular shape, and first recess 43 has a semicircular shape in a longitudinal sectional view. On the other hand, second recess 44 has a substantially flat shape in the longitudinal sectional view, and is shallower than first recess 43.

Each of first recess 43 and second recess 44 has a passage cross-sectional area that is sufficiently smaller than that of passage hole 42, such that air flows easily but working oil is resistant to flow.

Second recess 44 is formed by cutting out an annular shape from the outer peripheral face of flange 33*b*, and includes a lower end (upstream end) opened to first recess 43, and an upper end (downstream end) opened to back pressure chamber 38 in FIG. 28. Each of first recess 43 and second recess 44 has a passage in its radial direction which has a smaller cross-sectional area than exhaust passage 39.

As shown in FIG. 28, when tip portion 33*d* of lock pin 33 is inserted in lock hole 31 by the spring force of coil spring 40, passage hole 42 communicates with back pressure chamber 38 via first recess 43 and second recess 44. On the other hand, when lock pin 33 is made to travel backward maximally such that tip portion 33*d* of lock pin 33 gets out of lock hole 31 as indicated by one-dot chain lines in FIG. 28, the whole of first recess 43 and second recess 44 is closed by the inner peripheral face of larger-diameter hole section 32*b*. This blocks communication between passage hole 42 and back pressure chamber 38.

As in the other embodiments, the cross-sectional area of exhaust passage 39 and the passage cross-sectional area of groove 10*c* are set relatively large, and substantially equal to the maximum opening cross-sectional area of back pressure chamber 38 as shown in FIG. 28.

According to the seventh embodiment, at start of the engine, air, which is sent under pressure to retard hydraulic chamber 15 along with working oil, flows through passage hole 42 of communication passage 41, and first recess 43, and second recess 44, into back pressure chamber 38. The air, which has entered the back pressure chamber 38, is exhausted via exhaust passage 39 and between groove 10*c* and the outer peripheral face of tubular part 13*c* to the outside (atmosphere). This allows the air supplied to retard hydraulic chamber 15 to be exhausted quickly to the outside.

The special feature that the cross-sectional area of exhaust passage 39 is set relatively large, and substantially equal to the maximum cross-sectional area of back pressure chamber 38, serves to allow the air, which has flown from communication passage 41 (passage hole 42, first recess 43, second recess 44) into back pressure chamber 38, to be exhausted quickly to the outside. This serves to sufficiently suppress the influence of the air on the inside of back pressure chamber 38.

The feature that the passage cross-sectional area of second recess 44 is further smaller than passage hole 42, serves to ensure a preferable flow of the air while suppressing a flow of working oil. This serves to effectively suppress the flow of working oil into back pressure chamber 38.

The further feature of the seventh embodiment that first recess 43 and second recess 44 of communication passage 41 are formed in the outer peripheral face of flange 33*b*, serves to make the processing operation easy, and enhance the efficiency of manufacturing operation.

The valve timing control device may be applied to the exhaust valve side as well as the intake valve side. In this case, since working oil is first supplied to advance hydraulic chambers at engine starting, air mixed in the working oil can be exhausted quickly through the communication passage.

The opening area of small opening part 41*c* is regarded as the first cross-sectional area of communication passage 41 in the embodiments described above. However, if communication passage 41 has a portion (throttling portion) smaller in cross-sectional area than the opening of communication passage 41, the cross-sectional area of the throttling portion is regarded as the minimum cross-sectional area. Exhaust passage 39 is treated similarly.

Although each embodiment is applied to the valve timing control device provided with four shoes 11*a*-11*d* and four vanes 14*a*-14*d*, each embodiment may be applied to another structure provided with three shoes and three vanes, or five shoes and five vanes.

Furthermore, it may be applied to a sprocket as a drive rotation member, as well as pulley 1.

The housing may be formed integrally of a housing body and a pulley.

The internal combustion engine valve timing control devices according to the embodiments described above may be configured as follows.

In one configuration, an internal combustion engine valve timing control device includes: a housing structured to receive a torque from a crankshaft, wherein a working chamber is defined in the housing; a vane rotor fixed to a camshaft, and rotatably mounted in the housing, and including a vane separating the working chamber into a plurality of separated working chambers, wherein one of the housing and the vane rotor is a first rotating member, and another of the housing and the vane rotor is a second rotating member; an accommodation hole formed in the first rotating member; a lock member slidably mounted in the accommodation hole, and structured to be made by a hydraulic pressure to slide in a first slide direction, and including a pressure-receiving part structured to receive the hydraulic pressure from at least one of the separated working chambers; a biasing member mounted in the accommodation hole, and structured to bias the lock member in a second slide direction; a lock hole formed in the second rotating member, and structured to receive insertion of a tip portion of the lock member under a biasing force of the biasing member when the first rotating member and the second rotating member are in a predetermined relative rotational position; a back pressure chamber formed in the first slide direction from a rear end portion of the lock member in the accommodation hole; an exhaust passage formed in at least one of the first rotating member and the second rotating member, and structured to provide communication between the back pressure chamber and an outside; and a communication passage formed in the first rotating member to communicate with the working chamber, and including a first opening, wherein: the first opening is structured to be opened to the back pressure chamber when in a first state that the tip portion of the lock member is inserted in the lock hole, and be closed by the lock member when in a second state that the tip portion of the lock member is out of the lock hole; a first cross-sectional area is smaller than a second cross-sectional area; the first cross-sectional area is a smaller one of a minimum cross-sectional area of the communication passage and an open cross-sectional area of the first opening; and the second cross-sectional area is a smaller one of a minimum cross-sectional area of the exhaust passage and an open cross-sectional area of an opening of the exhaust passage opened to the back pressure chamber.

Preferably, the first cross-sectional area and the second cross-sectional area are set to have a ratio of the first cross-sectional area to the second cross-sectional area that is smaller than or equal to 0.18.

Preferably, the first cross-sectional area is set larger than or equal to 1 $mm^2$.

The setting of the cross-sectional area of the communication passage as described above serves to improve the performance of exhausting the air from the communication passage into the back pressure chamber, and exhausting the air from the back pressure chamber to the outside.

Preferably, the first cross-sectional area is noncircular.

The length of the circumference is greater as compared to a circular cross-section. This enhances the resistance of fluid flow. This is more influential on working oil than on air, because the working oil is more viscous. As a result, working oil is resistant to flow therethrough, and air flows therethrough easily.

Preferably, the lock member is structured such that the rear end portion of the lock member closes a part of the first opening of the communication passage facing the back pressure chamber when in the first state that the tip portion of the lock member is inserted in the lock hole; and the first cross-sectional area is of the first opening of the communication passage.

In general, in view of manufacturing, it is difficult and expensive to drill a small hole as a communication passage. The same effect can be obtained by first opening a large hole, and then closing a part of the large hole by the rear end portion of the lock member, thereby forming a communication hole for air vent with a reduced cost.

Further preferably, the first rotating member is the vane rotor; the communication passage includes a second opening opened to the working chamber; and the second opening includes a part located inside of a central axis of the accommodation hole in a radial direction about a rotation axis of the vane rotor.

The feature that the second opening of the communication passage facing the working chamber includes the part located inside of the central axis of the accommodation hole in the radial direction of the vane rotor, serves to cause the working oil, which has flown from the working chamber into the communication passage during engine starting, to be likely to move to the outer side in the communication passage under a centrifugal force of the vane rotor, while causing the air small in specific gravity to be likely to move to the inside. This allows a major part of the air to flow from the communication passage into the back pressure chamber with precedence to the working oil, and thereby enhances the performance of exhausting the air.

Preferably, the first rotating member is the vane rotor; the lock member includes a flange at an outer periphery of the rear end portion, wherein the flange is larger in diameter than the tip portion; the accommodation hole includes a larger-diameter hole section for slidably supporting the flange, and a smaller-diameter hole section for slidably supporting a first part of the lock member closer to the tip portion than the flange; the vane rotor includes an unlock passage; the unlock passage is structured to provide communication between the working chamber and a first part of the larger-diameter hole section closer to the tip portion than the flange, when in the first state that the tip portion of the lock member is inserted in the lock hole; and the first opening of the communication passage facing the back pressure chamber includes a part located outside of an opening of the unlock passage in a radial direction about a rotation axis of the vane rotor, wherein the opening of the unlock passage faces the back pressure chamber.

The feature that the first opening of the communication passage facing the back pressure chamber is located outside of the opening of the unlock passage in the radial direction, wherein the opening of the unlock passage faces the back pressure chamber, serves to enlarge sufficiently the length of sealing by the flange of the lock member between the first opening of the communication passage and the opening of the unlock passage.

Preferably, the first cross-sectional area is circular.

Preferably, the first rotating member is the vane rotor; the lock member includes a flange at an outer periphery of the rear end portion, wherein the flange is larger in outside diameter than the tip portion; the accommodation hole includes a larger-diameter hole section for sliding of the flange, and a smaller-diameter hole section for sliding of a first part of the lock member closer to the tip portion than the flange; the vane rotor includes an unlock passage; the unlock passage is structured to provide communication between the working chamber and a first part of the larger-diameter hole section closer to the tip portion than the flange, when in the first state that the tip portion of the lock member is inserted in the lock hole; and the first cross-sectional area of the communication passage is implemented by a circular hole smaller than a minimum cross-sectional area of the unlock passage.

The further feature that communication passage is a small hole serves to ensure a large area of sealing between the outer periphery of the flange of the lock member and the inner periphery of the accommodation hole, and thereby prevent working oil from being leaked via a clearance therebetween.

Preferably, the first rotating member is the vane rotor; the lock member includes a flange at an outer periphery of the rear end portion, wherein the flange is larger in outside diameter than the tip portion; the accommodation hole includes a larger-diameter hole section for sliding of the flange, and a smaller-diameter hole section for sliding of a first part of the lock member closer to the tip portion than the flange; the vane rotor includes an unlock passage; the unlock passage is structured to provide communication between the working chamber and a first part of the larger-diameter hole section closer to the tip portion than the flange, when in the first state that the tip portion of the lock member is inserted in the lock hole; the communication passage and the unlock passage are implemented by a first hole; and the communication passage is structured to communicate with the back pressure chamber via a throttling portion that is formed between a rear end edge of the flange and an inner periphery of the first hole when in the first state that the tip portion of the lock member is inserted in the lock hole.

The feature that both of the communication passage and the unlock passage are implemented by the single hole, requires only one drilling operation, so that the forming operation becomes very easy. The feature that the single hole is formed to have a large diameter, serves to enhance the efficiency of drilling operation while ensuring the accuracy of hole formation.

Preferably, the communication passage is structured such that the throttling portion is smaller in open cross-sectional area than the unlock passage when in the first state that the tip portion of the lock member is inserted in the lock hole.

Since the opening area of the communication passage may be small, when the tip portion of the lock member is out of the lock hole, it is possible to provide a sufficiently large sealing area between the outer periphery of the flange and the inner periphery of the accommodation hole. The enlarged sealing area serves to suppress the working oil from being leaked from the working chamber into the back pressure chamber.

Preferably, the first rotating member is the vane rotor; and the communication passage is formed in an outer end surface of the vane rotor, and is implemented by a groove that includes a first end opening facing the working chamber and a second end opening facing the back pressure chamber.

This feature makes the forming process easy.

Preferably, the communication passage includes a first recess and a second recess; the first recess is formed in a part of the first rotating member in sliding contact with the second rotating member, and includes a first end opened to the back pressure chamber; and the second recess is formed in a part of the second rotating member in sliding contact with the first rotating member, and includes a first end opened to the working chamber, and a second end opened to a second end of the first recess.

This feature allows to adjust the accuracy of formation of one of the first recess and the second recess, and set lower the accuracy of formation of the other.

Preferably, the first rotating member is the vane rotor, and is made of sintered metal; the second rotating member is the housing, and includes a housing body having a tubular shape, and a plate part made of a metal plate and closing an opening of the housing body; the first recess is formed in the vane rotor; and the second recess is formed in the plate part by press forming.

The feature that the second recess formed in the plate member is formed by press forming, serves to make the manufacturing easy, and suppress increase of the cost.

The feature that the second recess is formed by press forming, allows small and accurate formation of the second recess as compared to sintering formation. This allows the cross-sectional area of the second recess to be easily and accurately adjusted. The first recess of the vane rotor may be made of a metal material by sintering formation, and may have a relatively rough shape.

The feature that no communication is provided between the first recess and the second recess when the vane rotor is relatively rotated in the advance direction, serves to suppress the working oil from being leaked via a side clearance between the vane rotor and the plate member to the outside.

Preferably, the vane rotor is structured to separate the working chamber into a retard hydraulic chamber and an advance hydraulic chamber; and the communication passage is opened to the retard hydraulic chamber.

In case that the valve timing control device is applied to the intake valve side, air mixed in working oil can be exhausted through the communication passage, because the working oil is first supplied to the retard hydraulic chamber at engine starting.

Preferably, the vane rotor is structured to separate the working chamber into a retard hydraulic chamber and an advance hydraulic chamber; and the communication passage is opened to the advance hydraulic chamber.

In case that the valve timing control device is applied to the exhaust valve side, air mixed in working oil can be exhausted through the communication passage, because the working oil is first supplied to the advance hydraulic chamber at engine starting.

In another preferable configuration, an internal combustion engine valve timing control device includes: a housing structured to receive a torque from a crankshaft, wherein a working chamber is defined in the housing; a vane rotor fixed to a camshaft, and rotatably mounted in the housing, and including a vane separating the working chamber into a plurality of separated working chambers; an accommodation hole formed in the vane and extending in an axial direction of the vane rotor; a lock member slidably mounted in the accommodation hole, and structured to be made by a hydraulic pressure to slide in one direction, and including a pressure-receiving part structured to receive the hydraulic pressure from one of the separated working chambers; a lock hole formed in the housing, and structured to receive insertion of a tip portion of the lock member when the vane rotor is in a predetermined rotational position with respect to the housing, wherein the tip portion faces in a first slide direction of the lock member; a back pressure chamber formed in a second slide direction from a rear end portion of the lock member in the accommodation hole, wherein the rear end portion faces in the second slide direction of the lock member; a biasing member mounted in the back pressure chamber, and structured to bias the lock member in one direction; an exhaust passage formed between the housing and the vane rotor, and structured to provide communication between the back pressure chamber and an outside of the housing; and a communication passage formed in the vane rotor to communicate with the working chamber, and including an opening, wherein: the opening is structured to be opened to the back pressure chamber when in a first state that the tip portion of the lock member is inserted in the lock hole, and be closed by the lock member when in a second state that the tip portion of the lock member is out of the lock hole; a first cross-sectional area is smaller than a second cross-sectional area; the first cross-sectional area is a smaller one of a minimum cross-sectional area of the communication passage and an open cross-sectional area of the opening; and the second cross-sectional area is a minimum cross-sectional area of the exhaust passage.

Preferably, the first cross-sectional area and the second cross-sectional area are set to have a ratio of the first cross-sectional area to the second cross-sectional area that is smaller than or equal to 0.18.

Preferably, the first cross-sectional area is noncircular.

The invention claimed is:

1. An internal combustion engine valve timing control device comprising:

a housing structured to receive a torque from a crankshaft, wherein a working chamber is defined in the housing;

a vane rotor fixed to a camshaft, and rotatably mounted in the housing, and including a vane separating the working chamber into a plurality of separated working chambers, wherein one of the housing and the vane rotor is a first rotating member, and another of the housing and the vane rotor is a second rotating member;

an accommodation hole formed in the first rotating member;

a lock member slidably mounted in the accommodation hole, and structured to be made by a hydraulic pressure to slide in a first slide direction, and including a pressure-receiving part structured to receive the hydraulic pressure from at least one of the separated working chambers;

a biasing member mounted in the accommodation hole, and structured to bias the lock member in a second slide direction;

a lock hole formed in the second rotating member, and structured to receive insertion of a tip portion of the lock member under a biasing force of the biasing member when the first rotating member and the second rotating member are in a predetermined relative rotational position;

a back pressure chamber formed in the first slide direction from a rear end portion of the lock member in the accommodation hole;

an exhaust passage formed in at least one of the first rotating member and the second rotating member, and structured to provide communication between the back pressure chamber and an outside; and a communication passage formed in the first rotating member to communicate with the working chamber, and including a first opening, wherein:

the first opening is structured to be opened to the back pressure chamber when in a first state that the tip portion of the lock member is inserted in the lock hole, and be closed by the lock member when in a second state that the tip portion of the lock member is out of the lock hole;

a first cross-sectional area is smaller than a second cross-sectional area;

the first cross-sectional area is a smaller one of a minimum cross-sectional area of the communication passage and an open cross-sectional area of the first opening; and the second cross-sectional area is a smaller one of a minimum cross-sectional area of the exhaust passage and an open cross-sectional area of an opening of the exhaust passage opened to the back pressure chamber.

2. The internal combustion engine valve timing control device as claimed in claim 1, wherein the first cross-sectional area and the second cross-sectional area are set to have a ratio of the first cross-sectional area to the second cross-sectional area that is smaller than or equal to 0.18.

3. The internal combustion engine valve timing control device as claimed in claim 2, wherein the first cross-sectional area is set larger than or equal to 1 $mm^2$.

4. The internal combustion engine valve timing control device as claimed in claim 1, wherein the first cross-sectional area is noncircular.

5. The internal combustion engine valve timing control device as claimed in claim 1, wherein:

the lock member is structured such that the rear end portion of the lock member closes a part of the first opening of the communication passage facing the back pressure chamber when in the first state that the tip portion of the lock member is inserted in the lock hole; and the first cross-sectional area is of the first opening of the communication passage.

6. The internal combustion engine valve timing control device as claimed in claim 1, wherein:

the first rotating member is the vane rotor;

the communication passage includes a second opening opened to the working chamber; and the second opening includes a part located inside of a central axis of the accommodation hole in a radial direction about a rotation axis of the vane rotor.

7. The internal combustion engine valve timing control device as claimed in claim 1, wherein:

the first rotating member is the vane rotor;

the lock member includes a flange at an outer periphery of the rear end portion, wherein the flange is larger in diameter than the tip portion;

the accommodation hole includes a larger-diameter hole section for slidably supporting the flange, and a smaller-diameter hole section for slidably supporting a first part of the lock member closer to the tip portion than the flange;

the vane rotor includes an unlock passage;

the unlock passage is structured to provide communication between the working chamber and a first part of the larger-diameter hole section closer to the tip portion than the flange, when in the first state that the tip portion of the lock member is inserted in the lock hole; and the first opening of the communication passage facing the back pressure chamber includes a part located outside of an opening of the unlock passage in a radial direction about a rotation axis of the vane rotor, wherein the opening of the unlock passage faces the back pressure chamber.

8. The internal combustion engine valve timing control device as claimed in claim 1, wherein the first cross-sectional area is circular.

9. The internal combustion engine valve timing control device as claimed in claim 8, wherein:

the first rotating member is the vane rotor;

the lock member includes a flange at an outer periphery of the rear end portion, wherein the flange is larger in outside diameter than the tip portion;

the accommodation hole includes a larger-diameter hole section for sliding of the flange, and a smaller-diameter hole section for sliding of a first part of the lock member closer to the tip portion than the flange;

the vane rotor includes an unlock passage;

the unlock passage is structured to provide communication between the working chamber and a first part of the larger-diameter hole section closer to the tip portion than the flange, when in the first state that the tip portion of the lock member is inserted in the lock hole; and the first cross-sectional area of the communication passage is implemented by a circular hole smaller than a minimum cross-sectional area of the unlock passage.

10. The internal combustion engine valve timing control device as claimed in claim 1, wherein:

the first rotating member is the vane rotor;

the lock member includes a flange at an outer periphery of the rear end portion, wherein the flange is larger in outside diameter than the tip portion;

the accommodation hole includes a larger-diameter hole section for sliding of the flange, and a smaller-diameter hole section for sliding of a first part of the lock member closer to the tip portion than the flange;

the vane rotor includes an unlock passage;

the unlock passage is structured to provide communication between the working chamber and a first part of the larger-diameter hole section closer to the tip portion than the flange, when in the first state that the tip portion of the lock member is inserted in the lock hole;

the communication passage and the unlock passage are implemented by a first hole; and the communication passage is structured to communicate with the back pressure chamber via a throttling portion that is formed between a rear end edge of the flange and an inner periphery of the first hole when in the first state that the tip portion of the lock member is inserted in the lock hole.

11. The internal combustion engine valve timing control device as claimed in claim 10, wherein the communication passage is structured such that the throttling portion is smaller in open cross-sectional area than the unlock passage when in the first state that the tip portion of the lock member is inserted in the lock hole.

12. The internal combustion engine valve timing control device as claimed in claim 1, wherein:

the first rotating member is the vane rotor; and the communication passage is formed in an outer end surface of the vane rotor, and is implemented by a groove that includes a first end opening facing the working chamber and a second end opening facing the back pressure chamber.

13. The internal combustion engine valve timing control device as claimed in claim 1, wherein:

the communication passage includes a first recess and a second recess;

the first recess is formed in a part of the first rotating member in sliding contact with the second rotating member, and includes a first end opened to the back pressure chamber; and the second recess is formed in a part of the second rotating member in sliding contact with the first rotating member, and includes a first end opened to the working chamber, and a second end opened to a second end of the first recess.

14. The internal combustion engine valve timing control device as claimed in claim 13, wherein:

the first rotating member is the vane rotor, and is made of sintered metal;

the second rotating member is the housing, and includes a housing body having a tubular shape, and a plate part made of a metal plate and closing an opening of the housing body;

the first recess is formed in the vane rotor; and the second recess is formed in the plate part by press forming.

15. The internal combustion engine valve timing control device as claimed in claim 1, wherein:

the vane rotor is structured to separate the working chamber into a retard hydraulic chamber and an advance hydraulic chamber; and the communication passage is opened to the retard hydraulic chamber.

16. The internal combustion engine valve timing control device as claimed in claim 1, wherein:

the vane rotor is structured to separate the working chamber into a retard hydraulic chamber and an advance hydraulic chamber; and the communication passage is opened to the advance hydraulic chamber.

17. An internal combustion engine valve timing control device comprising:

a housing structured to receive a torque from a crankshaft, wherein a working chamber is defined in the housing;

a vane rotor fixed to a camshaft, and rotatably mounted in the housing, and including a vane separating the working chamber into a plurality of separated working chambers;

an accommodation hole formed in the vane and extending in an axial direction of the vane rotor;

a lock member slidably mounted in the accommodation hole, and structured to be made by a hydraulic pressure to slide in one direction, and including a pressure-receiving part structured to receive the hydraulic pressure from one of the separated working chambers;

a lock hole formed in the housing, and structured to receive insertion of a tip portion of the lock member when the vane rotor is in a predetermined rotational position with respect to the housing, wherein the tip portion faces in a first slide direction of the lock member;

a back pressure chamber formed in a second slide direction from a rear end portion of the lock member in the accommodation hole, wherein the rear end portion faces in the second slide direction of the lock member;

a biasing member mounted in the back pressure chamber, and structured to bias the lock member in one direction;

an exhaust passage formed between the housing and the vane rotor, and structured to provide communication between the back pressure chamber and an outside of the housing; and a communication passage formed in the vane rotor to communicate with the working chamber, and including an opening, wherein:

the opening is structured to be opened to the back pressure chamber when in a first state that the tip portion of the lock member is inserted in the lock hole, and be closed by the lock member when in a second state that the tip portion of the lock member is out of the lock hole;

a first cross-sectional area is smaller than a second cross-sectional area;

the first cross-sectional area is a smaller one of a minimum cross-sectional area of the communication passage and an open cross-sectional area of the opening; and the second cross-sectional area is a minimum cross-sectional area of the exhaust passage.

18. The internal combustion engine valve timing control device as claimed in claim 17, wherein the first cross-sectional area and the second cross-sectional area are set to have a ratio of the first cross-sectional area to the second cross-sectional area that is smaller than or equal to 0.18.

19. The internal combustion engine valve timing control device as claimed in claim 17, wherein the first cross-sectional area is noncircular.

* * * * *